US009995043B2

(12) United States Patent
Bierman

(10) Patent No.: US 9,995,043 B2
(45) Date of Patent: Jun. 12, 2018

(54) MOUNTING ASSEMBLY FOR GLASS BALUSTRADE

(71) Applicant: Smart Glass Systems Pty Ltd, Palm Beach, New South Wales (AU)

(72) Inventor: Reynold Bierman, New South Wales (AU)

(73) Assignee: Smart Glass Systems Pty Ltd, Palm Beach, New South Wales (AU)

( * ) Notice: Subject to any disclaimer, the term of this patent is extended or adjusted under 35 U.S.C. 154(b) by 0 days. days.

(21) Appl. No.: 14/915,174

(22) PCT Filed: Aug. 29, 2014

(86) PCT No.: PCT/AU2014/050202

§ 371 (c)(1),
(2) Date: Feb. 26, 2016

(87) PCT Pub. No.: WO2015/027295

PCT Pub. Date: Mar. 5, 2015

(65) Prior Publication Data

US 2016/0208496 A1 Jul. 21, 2016

(30) Foreign Application Priority Data

Aug. 29, 2013 (AU) ..... 2013903297
Jun. 10, 2014 (AU) ..... 2014902198

(51) Int. Cl.
*E04F 11/18* (2006.01)

(52) U.S. Cl.
CPC ..... *E04F 11/1812* (2013.01); *E04F 11/1817* (2013.01); *E04F 11/1853* (2013.01)

(58) Field of Classification Search
CPC ..... E04F 11/1812; E04F 11/1817; E04F 11/1853; F16B 2/12; E06B 3/5454; E06B 2003/5472; E04H 17/16
(Continued)

(56) References Cited

U.S. PATENT DOCUMENTS 3,426,493 A * 2/1969 Aspaas ..... E04B 2/92 52/204.591
3,630,490 A 12/1971 Horgan
(Continued)

FOREIGN PATENT DOCUMENTS

AU 2012216776 A1 5/2013
DE 201111872 U1 10/2011
(Continued)

OTHER PUBLICATIONS

International Search Report and Written Opinion, dated Dec. 10, 2014, by the Australian Patent Office for corresponding International Patent Application No. PCT/AU2014/050202, 15 pages.

*Primary Examiner* — Brent W Herring
(74) *Attorney, Agent, or Firm* — Klarquist Sparkman, LLP

(57) ABSTRACT

The present invention relates to a mounting 10 for glass balustrade and methods of installing the same. In particular aspects, the mounting 10 includes a first flange 14 and a second flange 15 that define therebetween a cavity 17 for receiving a glass panel 11. The mounting 10 also includes a clamping member 27 which can be actuated by a threaded member 28 provided in the first flange 14 to frictionally clamp the glass panel 11 within the cavity 17. The mounting 10 includes numerous securing holes for securing to a structure 22 such as a cement pad, a beam, or a piece of timber. In certain aspects, the mounting is configured to clamp two corner portions of separate panels of glass 110, 120 to form the glass balustrade.

9 Claims, 21 Drawing Sheets

(58) Field of Classification Search
USPC ..... 52/126.7, 204.65, 766, 800.12, 800.14, 52/800.16, 832; 403/374.3; 256/24; 248/689, 229.1
See application file for complete search history.

(56) References Cited

U.S. PATENT DOCUMENTS 4,054,268 A 10/1977 Sher
4,905,970 A * 3/1990 Holmsten ..... E04H 17/16 256/24
5,333,428 A * 8/1994 Taylor ..... B44C 5/08 264/254
8,500,110 B2 * 8/2013 Allen ..... E04F 11/1851 269/297
8,549,817 B2 * 10/2013 Burke ..... A47F 3/12 52/716.8
2006/0284522 A1 * 12/2006 Burke ..... A47F 3/12 312/116
2007/0145340 A1 * 6/2007 Brabeck ..... E04H 17/163 256/24
2010/0225040 A1 * 9/2010 Allen ..... E04F 11/1851 269/297
2010/0288987 A1 * 11/2010 Irving ..... A63C 19/08 256/25
2011/0260129 A1 * 10/2011 Schopf ..... E04F 11/1851 256/24
2012/0235102 A1 * 9/2012 Schopf ..... E04H 17/16 256/24
2012/0261631 A1 * 10/2012 Schopf ..... E04F 11/1851 256/24
2014/0334874 A1 * 11/2014 Allen ..... E04C 1/42 403/374.3
2016/0123078 A1 * 5/2016 Bouthillier ..... E06B 11/045 49/420

FOREIGN PATENT DOCUMENTS

NL 7605395 A 5/1976
WO WO-2009/02896 A1 3/2009
WO WO-2013/064985 A1 5/2013

* cited by examiner

MOUNTING ASSEMBLY FOR GLASS BALUSTRADE

CROSS REFERENCE TO RELATED APPLICATIONS

This is the U.S. National Stage of International Application No. PCT/AU2014/050202, filed Aug. 29, 2014, which was published in English as WO/2015/027295-A1 under PCT Article 21(2), which in turn claims the benefit of Australian Provisional Patent Application No. 2014902198, filed Jun. 10, 2014, and Australian Provisional Patent Application No. 2013903297, filed Aug. 29, 2013. Each of these applications is hereby incorporated by reference herein as if set forth fully in their entireties.

TECHNICAL FIELD

The present invention relates to mountings for glass balustrade and method of installation.

BACKGROUND

It is not unusual for fencing and balustrades to be formed of panels, such as glass sheet. Where glass sheet is employed, it is not uncommon for the balustrade or fencing to be "frameless". This requires the sheet to be supported by spigots. Typically the spigots provide a slot within which the glass is secured.

Each glass sheet is supported by two or more spigots, with the glass sheet being engaged by the spigots at positions spaced from the corners of the glass sheet, with the glass sheet being generally vertically orientated. The abovementioned spigots have the disadvantage that they are configured so that each spigot only engages a single sheet. Additionally, a problem with these abovementioned spigots is that they are only adapted to mount the sheet so that it extends generally upwardly from a horizontal surface, such as the floor of a balcony or a pool surround.

Other mounting systems exist known as stand offs. This system involves holes being cut into the glass panels which can be time consuming and costly.

There is therefore a need to overcome or at least alleviate one or more of the abovementioned disadvantages or provide a useful commercial alternative.

The reference in this specification to any prior publication (or information derived from it), or to any matter which is known, is not, and should not be taken as, an acknowledgement or admission or any form of suggestion that that prior publication or information derived from it) or known matter forms part of the common general knowledge in the field of endeavour to which this specification relates.

SUMMARY OF INVENTION

In a first aspect there is provided a method of securing a mounting to a structure for a glass balustrade arrangement the mounting including a first flange having a first threaded hole, a second flange having a second threaded hole coaxial with the first threaded hole and also having a third threaded hole, a cavity located between the first and second flange, and one or more clamping members associated with the first and second flanges, wherein the method includes.

winding the mounting to secure a first threaded member which extends from the second flange into a first hole of the structure;

progressing a second threaded member through the first threaded hole of the first flange and partly through the second threaded hole of the second flange, wherein a portion of the second threaded member projects and secures within a second hole of the structure;

locating a glass panel within the cavity of the mounting; and clamping the glass panel by actuating the one or more clamping members of the mounting, wherein at least a portion of the clamped glass panel, overhangs an edge of the structure.

In certain embodiments, the method includes securing the first threaded member with a third threaded hole located in the second flange.

In certain embodiments, the method includes progressing a first screw located within the first threaded hole of the first flange after securing the second threaded member within the second hole of the structure, wherein progression of the first screw causes the first screw to contact one of the clamping members to thereby clamp the glass panel.

In certain embodiments, the mounting includes an additional threaded hole in the first flange for receiving an additional screw, wherein the method includes progressing the additional screw within the additional threaded hole to contact one of the clamping members to thereby clamp the glass panel.

In certain embodiments, the first screw is initially engaged within the first threaded hole, wherein the method includes withdrawing the first screw from the first threaded hole prior to progressing the second threaded member through the first threaded hole.

In certain embodiments, the method includes inserting a portion of a tool through the first threaded hole to engage and progress the portion of the second threaded member through the second threaded hole of the second flange.

In certain embodiments, the method includes:

removing at least one clamping member from the mounting prior to progressing the second threaded member through the first threaded hole of the first flange; and relocating the at least one removed clamping member after the second threaded member has been secured within the second hole of the structure.

In a second aspect there is provided a mounting for an adjacent pair of panels, the mounting including:

a body having a first slot defined by a first pair of flanges and a second slot defined by a second pair of flanges, each slot being configured to receive a respective one of the panels so that the panels are supported in an upward orientation with adjacent edges;

a first clamping member in the first slot;

a second clamping member in the second slot; and a plurality of threaded fasteners threadably engaged with the body and engaged with the clamping members to urge the clamping members into clamping engagement with a respective one of the panels.

In certain embodiments, the mounting includes a third clamping member and a fourth clamping member, the third clamping member being located in the first slot and positioned relative to the first clamping member so that the respective panel can be located therebetween, the fourth clamping member is located in the second slot and positioned relative to the second clamping member so that the respective panel can be located therebetween.

In certain embodiments, the first pair of flanges are co-extensive and substantially parallel, and the second pair of flanges are co-extensive and substantially parallel.

In certain embodiments, said body includes a spacer portion located between the pairs of flanges.

In certain embodiments, the first slot is aligned with the second slot so that the slots are generally co-planar.

In certain embodiments, the slots are inclined by an acute or obtuse angle.

In certain embodiments, the slots are inclined by 90°.

In certain embodiments, the body includes a stem to fix the mounting to a structure.

In certain embodiments, the mounting includes a mounting flange, wherein the first and second pairs of flanges project substantially vertically and the mounting flange projects substantially horizontally, wherein the mounting flange includes a plurality of holes to fasten the mounting to a substantially horizontal surface of the structure.

In certain embodiments, the body includes a rear surface which rests against a structure for the mounting to be secured thereto, wherein the rear surface includes one or more threaded holes for engaging a respective one or more threaded members to secure within holes defined in the structure.

In certain embodiments, the body includes a threaded fastener hole to receive one of the threaded fasteners for engaging one of the clamping members, wherein the threaded fastener hole is coaxial with one of the threaded holes provided in the rear surface.

In certain embodiments, one of the threaded holes in the rear surface is configured to receive a threaded screw which is progressed within the respective threaded hole for urging against the structure when the mounting is secured to the structure.

In certain embodiments, the rear surface of the body includes a further threaded hole for receiving a threaded screw which is progressed within the further threaded hole for urging against the structure when the mounting is secured to the structure.

In a third aspect there is provided a method of installing a mounting according to the first aspect, wherein the method includes:

securing the mounting to a structure;

locating a first glass panel within the first slot;

locating, a second glass panel within the second slot; and actuating the plurality of threaded fasteners to urge the clamping members to clamp against the first and second panels.

In certain embodiments, the mounting includes a mounting flange, wherein the first and second pairs of flanges project substantially vertically and the mounting flange projects substantially horizontally, wherein the mounting flange includes a plurality of holes to fasten the mounting to a substantially horizontal, surface of the structure, wherein the method includes securing the mounting flange to the substantially horizontal surface of the structure.

In certain embodiments, the body includes a rear surface which rests against a structure for the mounting to be secured thereto, wherein the rear surface includes one or more threaded holes, wherein the method includes:

engaging a respective one or more threaded members with the one or more threaded holes in the rear surface; and securing each threaded member within holes defined in the structure.

In certain embodiments, the body includes a threaded fastener hole to receive one of the threaded fasteners for engaging one of the clamping members, wherein the threaded fastener hole is coaxial with one of the threaded holes provided in the rear surface, wherein the method includes progressing one of the threaded members through the threaded fastener hole and to at least partially progress the respective threaded member to project through the coaxial threaded hole provided in the rear surface.

In certain embodiments, the method includes inserting a portion of a tool through the threaded fastener hole to progress the threaded member to project rearward of the rear surface.

In certain embodiments, the method includes progressing a threaded screw within one of the threaded holes for urging against the structure when the mounting is secured to the structure.

In certain embodiments, the rear surface of the body includes a further threaded hole for receiving a further threaded screw, wherein the method includes progressing the further threaded screw within the further threaded hole for urging against the structure when the mounting is secured to the structure.

In a fourth aspect there is provided a mounting for a glass panel of a glass balustrade arrangement, the mounting including:

a base, the base being of a "U-shaped" configuration so as to have a first and a second flange joined by an end flange, the flanges providing an open cavity within which the glass panel is to rest so as to be at least partly supported by the mounting with the glass panel generally upwardly oriented, wherein the first and second flanges are generally upright, and said end flange is a bottom flange;

a clamping member adjacent the first flange and located in the cavity;

at least one threaded fastener engaged with said first flange and clamping member to urge the clamping member to engage the glass panel to clamp the glass panel between the second flange and clamping member to fix the glass panel to the mounting; and wherein the second flange has at least one aperture which at least another threaded fastener engages to fix the mounting to a substantially vertical surface of an edge of a structure such that at least a portion of the glass panel which rests within the cavity overhangs the edge of the structure.

In certain embodiments, said second flange has an inner surface to be located adjacent the glass panel, and an outer surface, with each aperture extending between the inner and outer surfaces.

In certain embodiments, said inner and outer surfaces are generally upright.

In certain embodiments, the clamping member includes or at least is partially made of a polymer material.

In certain embodiments, each aperture is generally horizontally extending.

In certain embodiments, said cavity is open upwardly.

In certain embodiments, said second flange includes a first flange portion that is generally upwardly oriented, and a second flange portion extending generally horizontally from the first flange portion, with at least one of the apertures formed in said second flange portion so as to be generally vertically extending.

In certain embodiments, the first flange includes a threaded fastener hole to receive one of the threaded fasteners for urging the clamping member to clamp the glass panel, wherein the threaded fastener hole is coaxial with one of the at least one aperture provided in the second flange.

In certain embodiments, one of the at least one aperture in the second flange is configured to receive a threaded screw which is progressed within the respective aperture for urging against the structure when the mounting is secured thereto.

In certain embodiments, the second flange includes a further aperture for receiving a threaded screw which is progressed within the further threaded hole for urging against the structure when the mounting is secured thereto.

Other aspects and embodiments will be realised throughout the description of the preferred embodiments.

BRIEF DESCRIPTION OF DRAWINGS

Example embodiments should become apparent from the following description, which is given by way of example only, of at least one preferred but non-limiting embodiment, described in connection with the accompanying figures.

DESCRIPTION OF EMBODIMENTS

Figure 2:
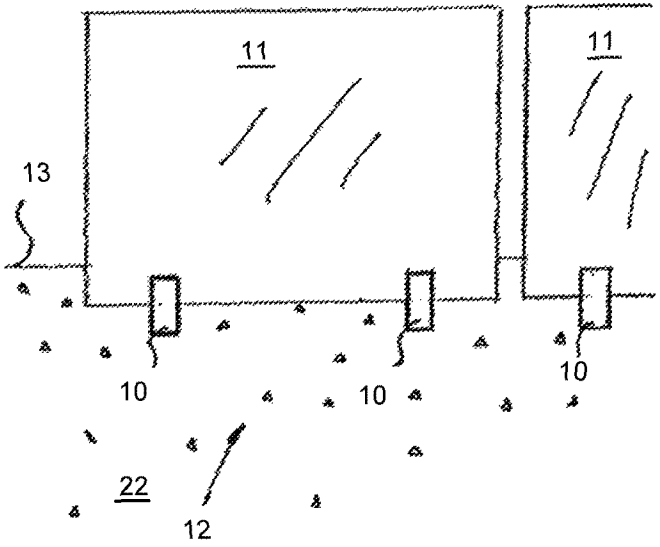
FIG. 2 is a schematic side elevation of a fence having a plurality of the mountings of FIG. 1 supporting glass sheets.

The following modes, given by way of example only are described in order to provide a more precise understanding of the subject matter of a preferred embodiment or embodiments. In the figures, incorporated to illustrate features of an example embodiment like reference numerals are used to identify like parts throughout the figures.

In FIGS. 1 to 4 there is schematically depicted a mounting 10 for a panel such as glass sheet 11. Typically a plurality of the mountings 10 would be employed to support a plurality of the sheets 11 so as to fix the sheets 11 to a generally upright surface (such as the edge of a concrete pad) 12. The sheets 11 would extend upwardly from a generally horizontally oriented floor surface 13.

The mounting 10 is of a generally "U-shaped" configuration so as to have a first generally upright flange 14 and a second generally upright flange 15. The flanges 14 and 15 are spaced and preferably parallel and co-extensive, and joined by a bottom (end) flange 16. The flanges 14, 15 and 16 cooperate to provide an upwardly open cavity 17 within which one of the sheets 11 is located so as to be supported by the mountings 10 and secured in a, generally upright orientation fixed to the surface 12.

In this embodiment the flange 15 has an inner generally upright inner surface 19 (adjacent the sheet 11) and a generally upright outer surface 20. Passages 18 extend generally horizontally between the surfaces 19 and 20 so that the threaded fasteners 21 may pass through the flange 15 and be engaged in the concrete pad 22 to fix the mounting 10 to the concrete pad 22. Preferably, the flange 15 has recesses 23 within which the head of each of the fasteners 21 may be located.

In the present embodiment the mounting 10 is an assembly in respect of the flanges 14, 15 and 16, with the flange 16 secured to the flange 15, and slab 22 by one or more of the threaded fasteners 18, with the flange 14 provided with a cavity 24 to receive the head from the threaded fastener 18. The flange 14 is secured to the flange 16 (and therefore the flange 15) by further threaded fasteners 25.

The flange 14 at its internal face is provided with a cavity 26 that receives a clamp pad 27 preferably formed of plastics material. The pad 27 is urged into engagement with the sheet 11 by threaded fasteners 28 that the sheet 11 is frictionally retained in the recess 17. As can be seen in FIGS. 1 to 4, the threaded fasteners 28 engage with threaded holes 99 provided by flange 14.

Figure 5:
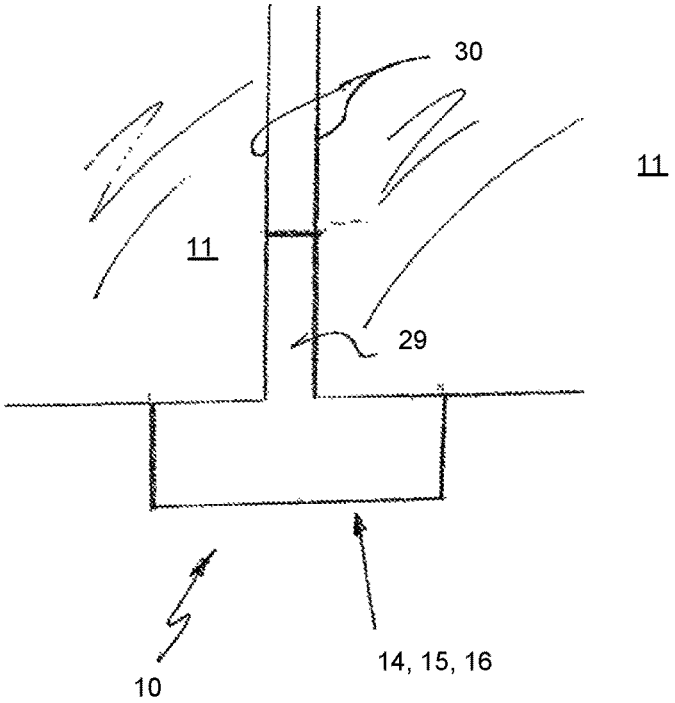
FIG. 5 is a schematic side elevation of a modification of the mounting of FIG. 1.
Figure 6:
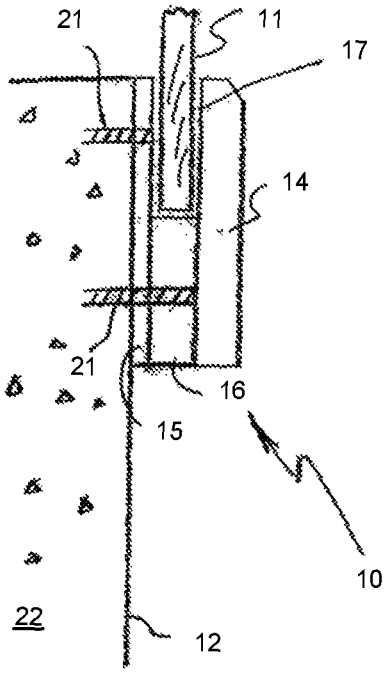
FIG. 6 is a schematic sectioned side elevation of the mounting of FIG. 5.
Figure 7:
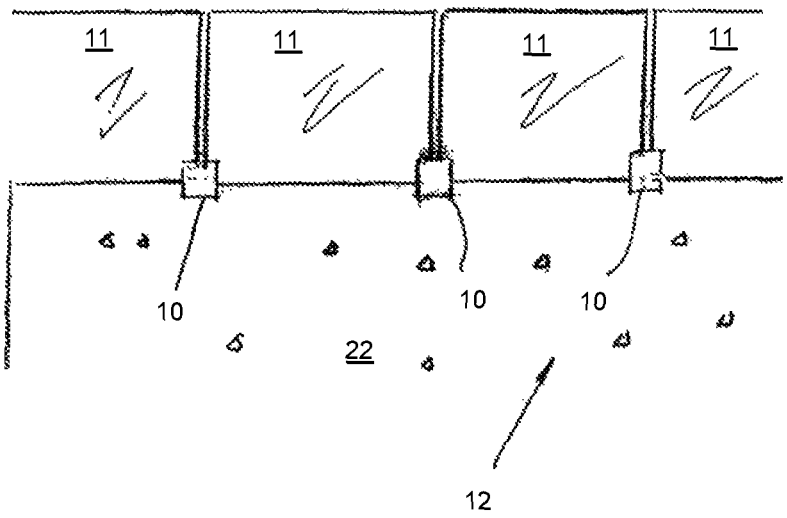
FIG. 7 is a schematic side elevation of a glass fence employed in the mounting of FIG. 5.

In the embodiment of FIGS. 5, 6 and 7, the mounting 10 is modified so as to engage the corners of the panels 11. More particularly one of the flanges 14, 15 or 16 is provided with a projection 29 that is located between adjacent edges 30 of adjacent panels 11.

In FIGS. 8 to 12 there is illustrated a further modification of the mounting 10. In this embodiment the flange 15 includes a first flange portion 31 that is generally vertically oriented, and a second flange portion 32 that is generally horizontally oriented so as to project laterally from the flange portion 31. The flange portion 32 is provided with a plurality of apertures 33 through which threaded fasteners 34 pass to engage in the concrete slab 22 to secure the mounting 10 to the concrete pad 22, and more particularly the generally horizontal surface 35 of the concrete pad 22. However the sheet 11 is adjacent the surface 12. As shown in FIG. 10B, mortar 3300 may be placed at the rear of the second flange portion 32 and also over the top surface of the second flange portion 32 to enable a tiles or tiles 3310 to be laid over the second flange portion such that the second flange portion is not visible. As also shown in FIG. 10B, the mounting 10 can include a passage 102 that passes through flanges 14, 15 and 16 to enable an optional bolt to secure the mounting to the structure 22.

Figure 13:
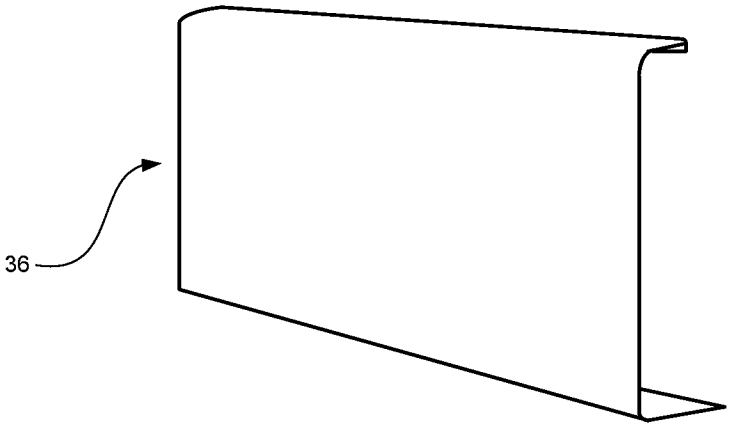
FIG. 13 is an schematic isometric view of a cover strip for a mounting.
Figure 14:
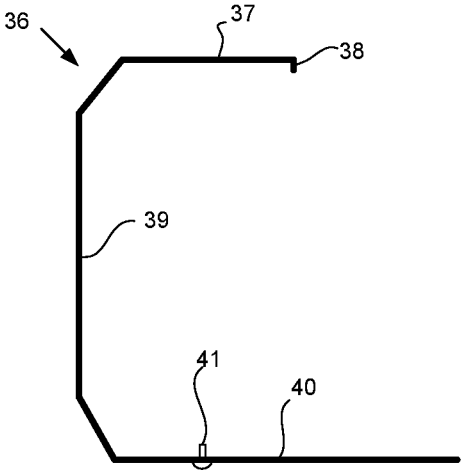
FIG. 14 is a schematic end elevation of the cover strip of FIG. 13.

In FIGS. 13 and 14 there is schematically depicted a cover strip 36 for securing to the mounting 10. The cover strip 36 extends longitudinally of the mounting 10 and includes an upper flange 37 with a downwardly extending lip 38 that engages in the recess 17 so as to be located between the panel 11 and the rear surface of flange 14. Extending downwardly from the flange 37 is a flange 39 that extends downwardly over the flange 14. Extending laterally from a lower portion of the flange 39 is a further horizontal flange 40 that extends across the lower surfaces of the flanges 14, 15 and 16. A threaded fastener 41 passes through the flange 40 and engages in the threaded passage in the lower portions of one of the flanges 14, 15 or 16. Whilst FIGS. 13 and 14 depict that the cover strip 36 includes the downwardly extending lip 38, it is possible that the cover strip 36 is not provided with the downwardly extending lip 38. In this variation, the upper flange 37 is secured to the mounting 10 via a fastener such as a screw or the like.

Figure 15:
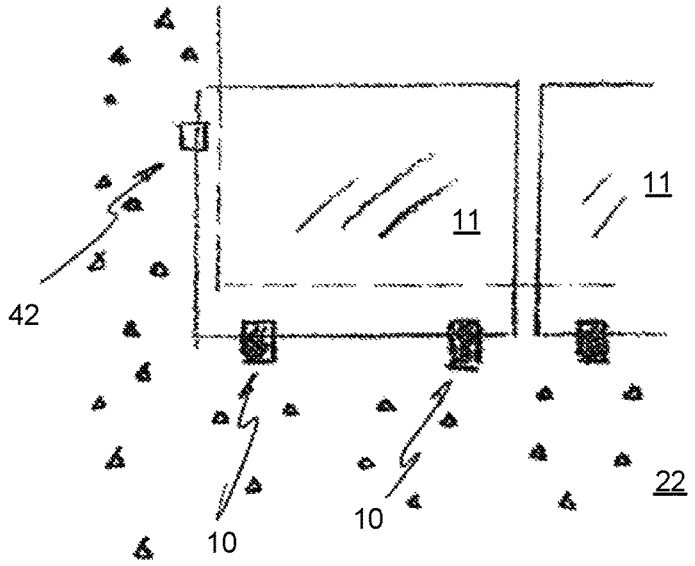
FIG. 15 is a schematic further front elevation of a fence.
Figure 16:
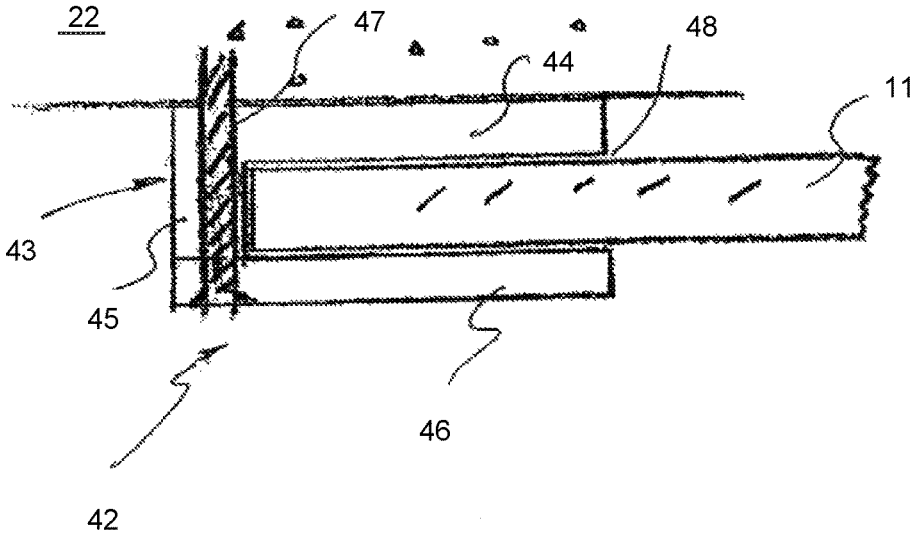
FIG. 16 is a schematic sectioned plan view of a mounting employed in the fence of FIG. 15.
Figure 17:
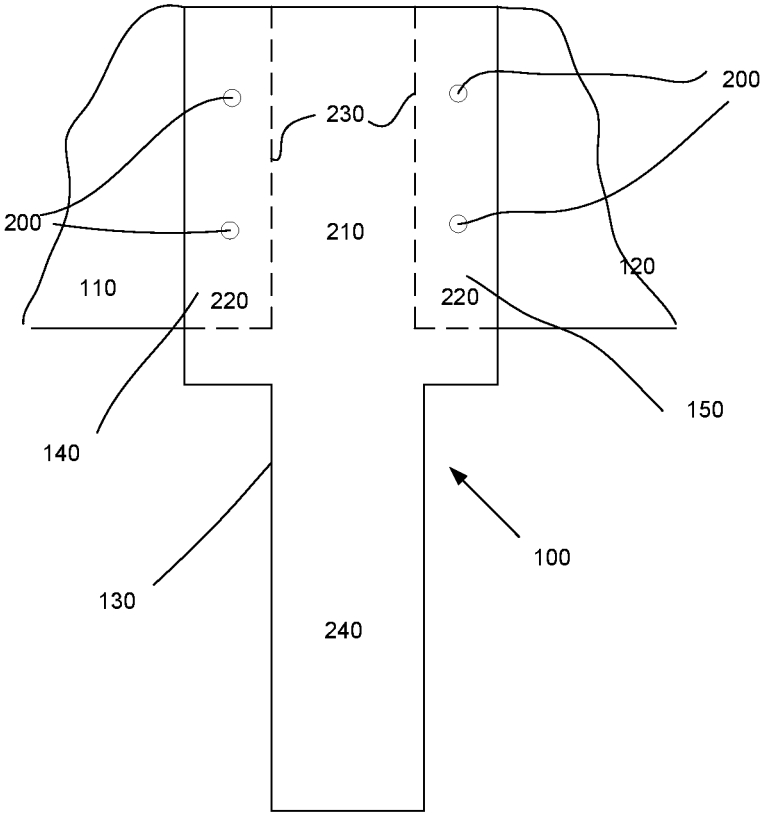
FIG. 17 is a schematic front elevation of a pair of glass sheets and a mounting therefore.
Figure 18:
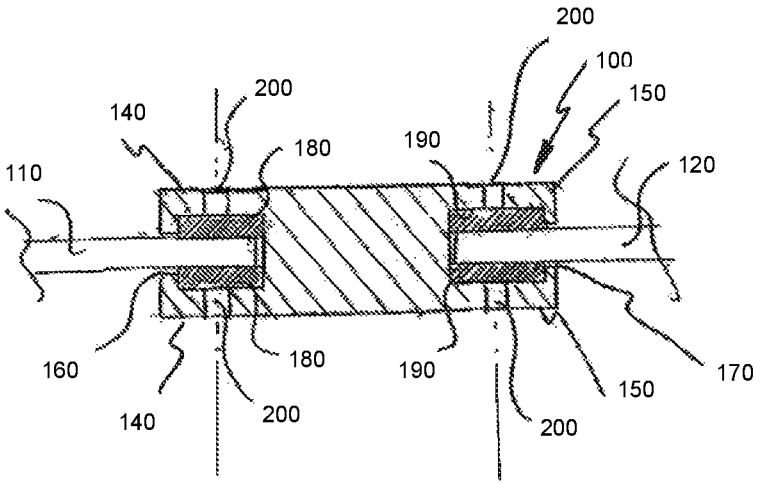
FIG. 18 is a schematic parts sectioned plan view of the glass sheets and mounting of FIG. 17.
Figure 21:
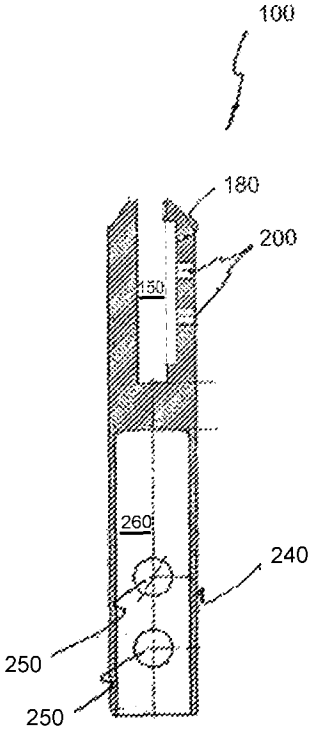
FIG. 21 is a schematic sectioned side elevation of the mounting of FIG. 19.
Figure 20:
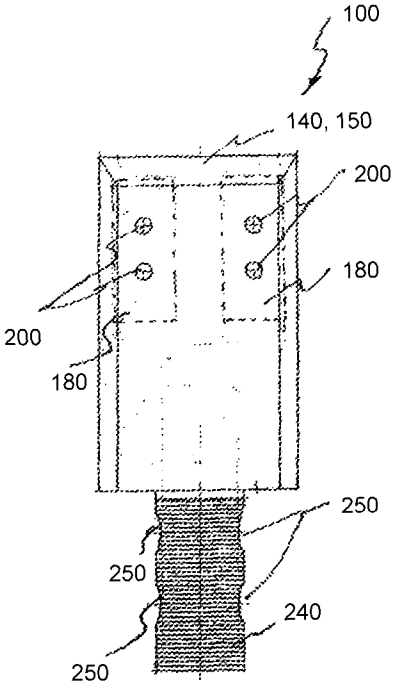
FIG. 20 is a schematic front elevation of the mounting of FIG. 19.
Figure 22:
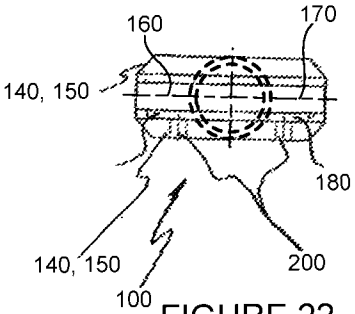
FIG. 22 is a schematic top plan view of the mounting of FIG. 19.
Figure 19:
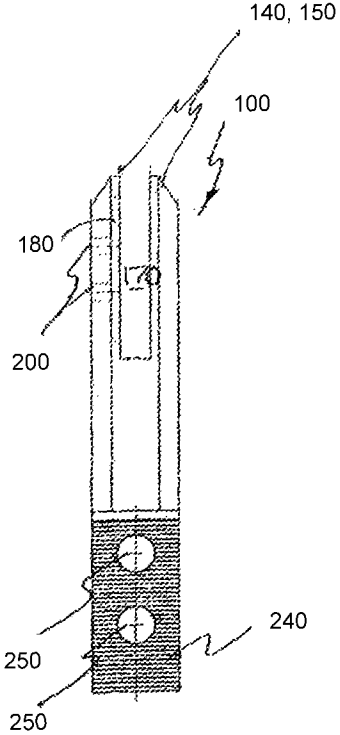
FIG. 19 is a schematic side elevation of a modification of the mounting of FIG. 17.
Figure 25:
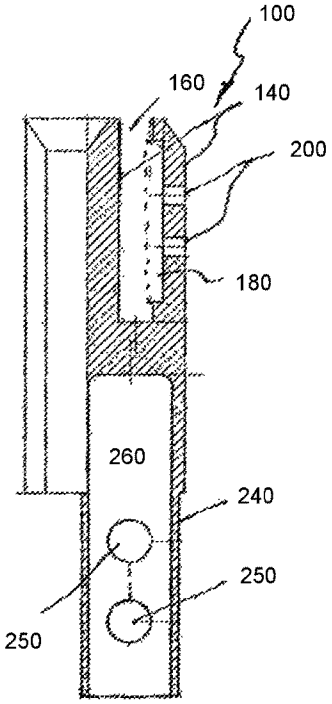
FIG. 25 is a schematic sectioned front elevation of the mounting of FIG. 23.
Figure 24:
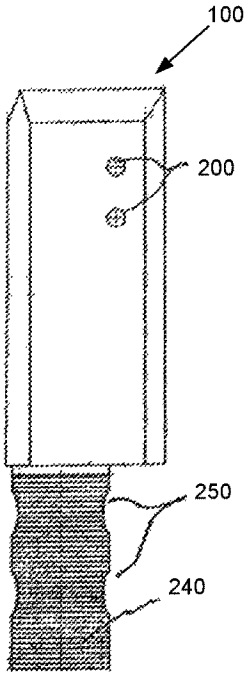
FIG. 24 is a schematic front elevation of the mounting of FIG. 23.
Figure 26:
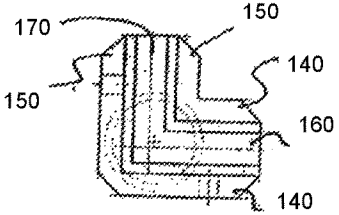
FIG. 26 is a schematic top plan view of the mounting of FIG. 23.
Figure 23:
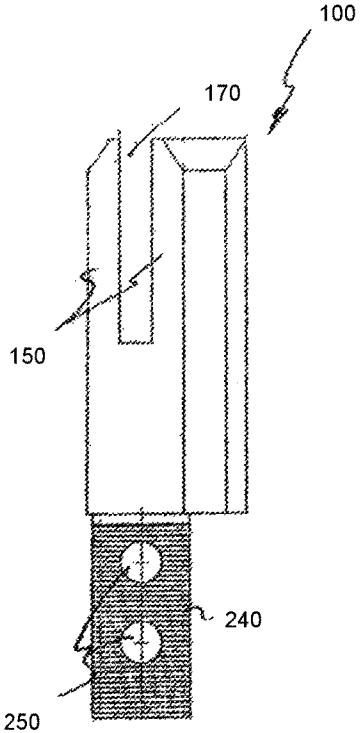
FIG. 23 is a schematic side elevation of a modification of the mounting of FIG. 17.

In FIGS. 15 and 16 there is schematically depicted the panels 11 and mountings 10, together with an additional support bracket 42. The bracket 42 engages a generally upwardly extending edge portion of the panel 11 while the mountings 10 engage a generally horizontally extending lower edge portion of the panels 11.

As shown in FIG. 16, the bracket 42 includes a base 43 that is of an "L" configuration so as to have a flange portion 44 and an end portion 45. The bracket 42 includes a further flange portion 46 with a threaded fastener 47 passing through the flange portions 44 and 46 and end portion 45. The portions 44, 45 and 46 cooperate to provide a generally horizontally open cavity 48 that receives the vertical edge portion of the panel 11. The flange portions 44 and 46 are generally co-extensive and parallel. The threaded fastener 47 engages within concrete slab 22 to fix the bracket 42 to the slab 22.

Figure 1:
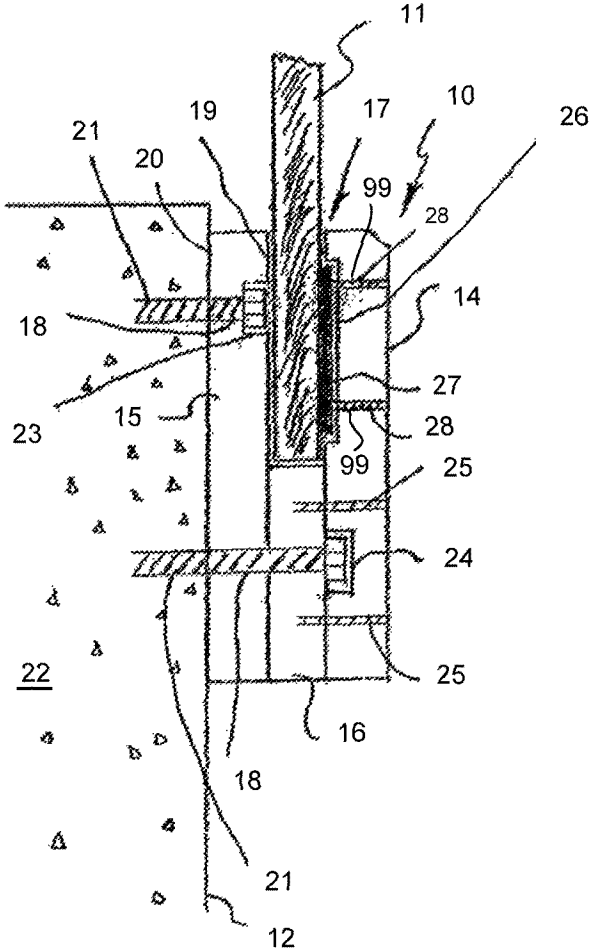
FIG. 1 is a schematic sectioned side elevation of a glass sheet and mounting.
Figure 3:
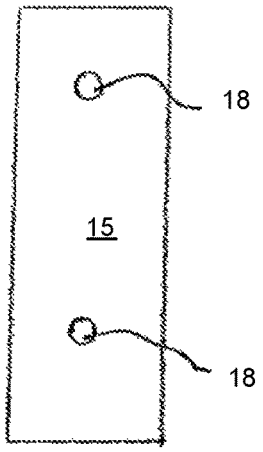
FIG. 3 is a schematic rear elevation of the mounting of FIG. 1.
Figure 4:
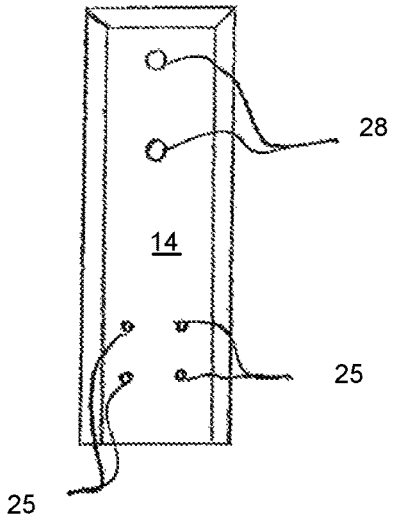
FIG. 4 is a schematic front elevation of the mounting of FIG. 1.
Figure 8:
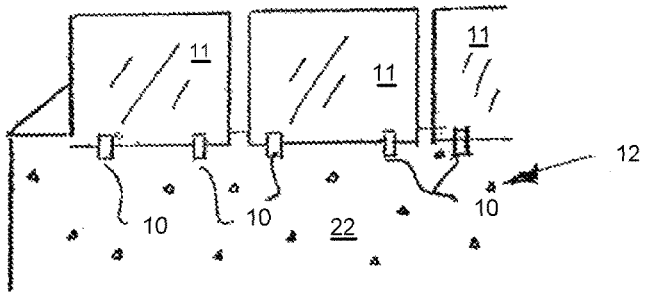
FIG. 8 is a schematic side elevation of a glass fence.
Figure 9:
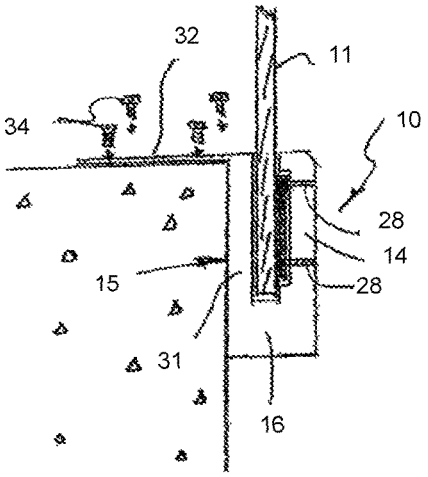
FIG. 9 is a schematic side elevation of portion of the fence of FIG. 8 in side elevation.
Figure 10A:
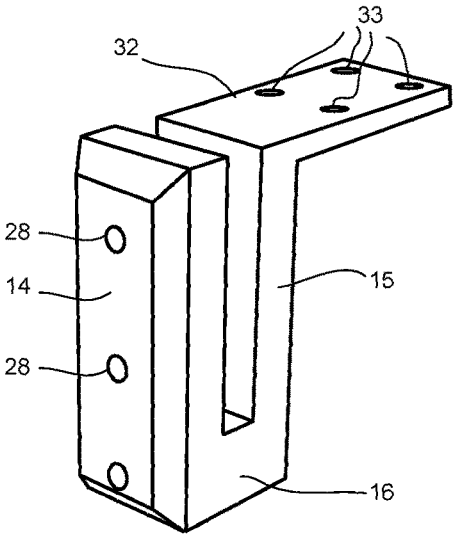
FIG. 10A is a schematic isometric view of the mounting of FIG. 9.
Figure 10B:
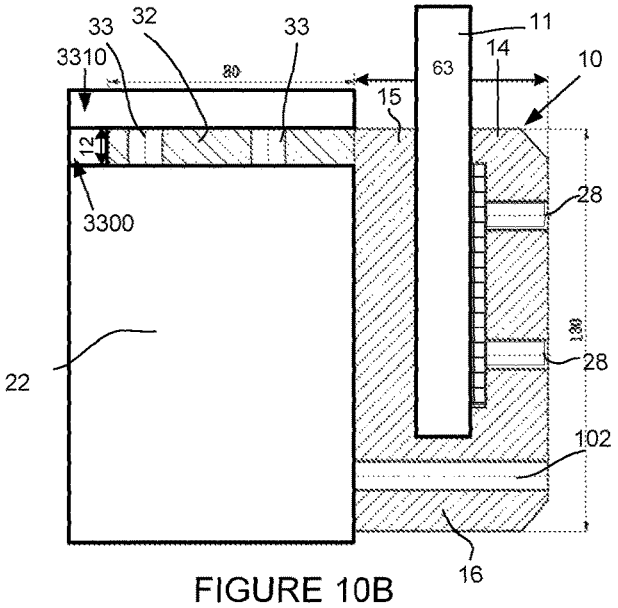
FIG. 10B is a schematic cross-section view of the mounting of FIG. 9.
Figure 11:
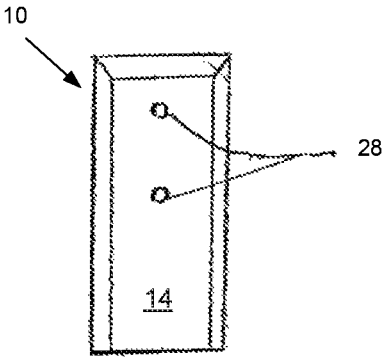
FIG. 11 is a schematic front elevation of the mounting of FIG. 9.
Figure 12:
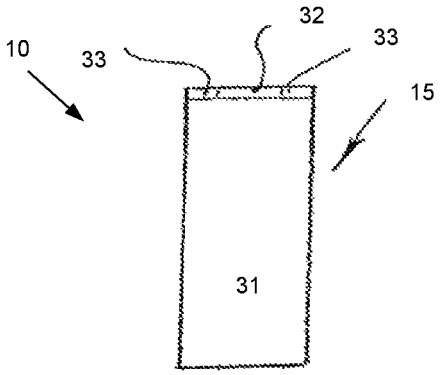
FIG. 12 is a schematic rear elevation of the mounting of FIG. 9.
Figure 35:
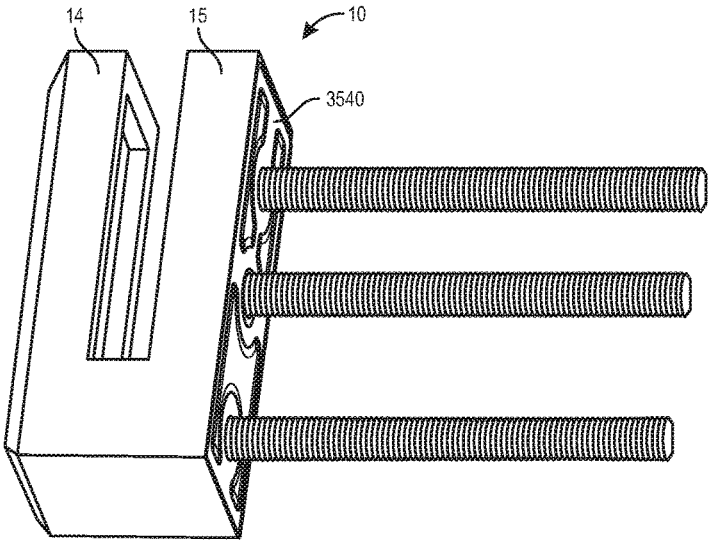
FIG. 35 is a perspective view of another example of a mounting.
Figure 36:
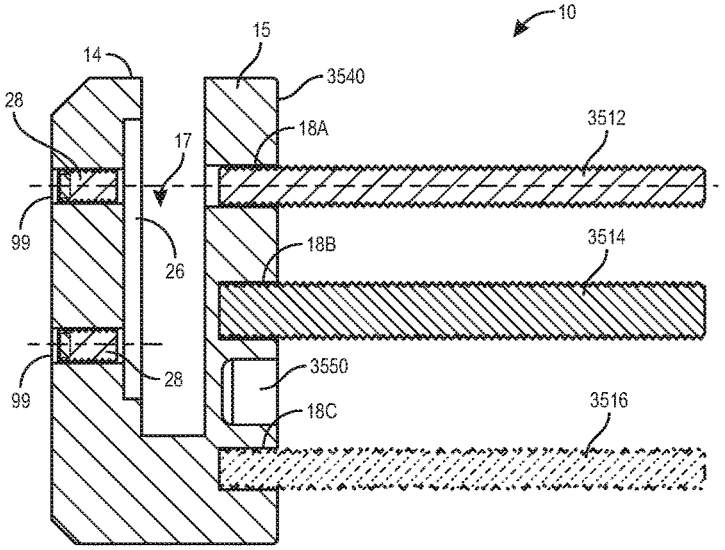
FIG. 36 is a cross-sectional view of the mounting of FIG. 35.
Figure 37:
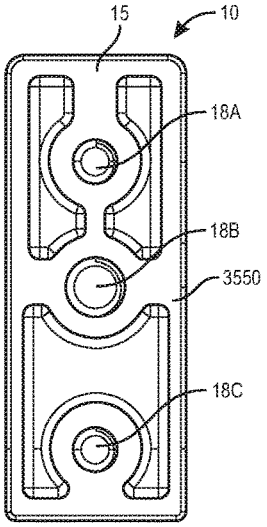
FIG. 37 is a rear view of the mounting of FIG. 35.

Referring to FIGS. 35 to 37 there is shown a further example of the mounting 10, in particular the second side flange 15 includes three apertures 18A, 18B, 18C, wherein each aperture can receive therein a corresponding threaded fastener 3512, 3514, 3516 to engage a structure to fix the mounting 10 to the structure. Preferably, the second side flange 15 is attached to a substantially vertical surface, such as the vertical surface of an edge of a concrete slab or the like as shown in FIGS. 1, 6 and 8. As the second flange 15 of the mounting 10 is secured substantially flush against the vertical surface structure, the area of the horizontal surface of the structure such as a balcony is free of upstanding stems and the like. In this arrangement, at least a portion of the glass panel 11 which rests within the cavity 17 overhangs the edge of the structure. Therefore, the "over-the-edge" mounting arrangement provides a significant advantage as it allows for better utilisation of the usable horizontal space. The mounting 10 also provides significant aesthetic advantages as there are no unsightly upstanding stems associated with the mounting 10 which protrude from the horizontal surface adjacent the edge of the structure. Furthermore, the mounting 10 provides safety advantages as the reduction of upwardly extending stems removes various tripping hazards.

As shown in FIG. 36, the top aperture 18A in the second flange 15 passes through the second flange 15 and into the cavity which can be advantageous for particular installations methods as will be discussed below. The other two apertures 18B, 18C are blind holes which do not pass through the second flange 15 and into the cavity 17.

As shown in FIGS. 35 and 37, the rear surface 3540 of the second side flange 15 includes cut-out sections 3550 to reduce the amount of material of the mounting 10 as well as reduce the weight of the mounting 10 to approximately 2 kilograms. In a particular embodiment, the mounting 10 is made of stainless steel.

Figure 38:
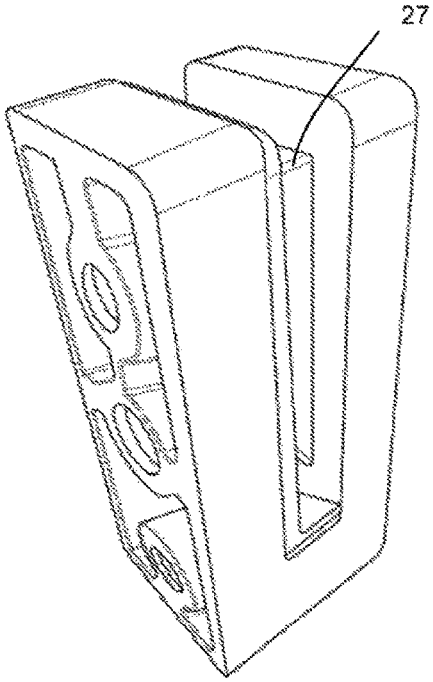
FIG. 38 is a rear perspective view of the mounting of FIG. 35.
Figure 39:
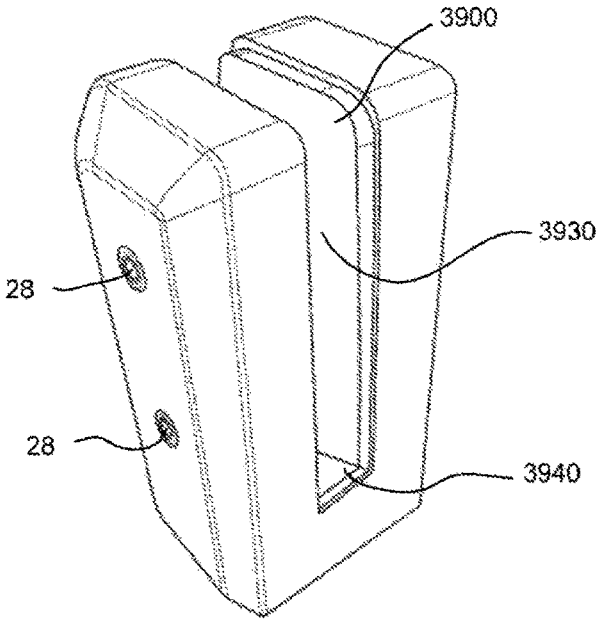
FIG. 39 is a front perspective view of the mounting of FIG. 35.

The mounting 10 of FIGS. 35 to 37 is preferably designed for glass balustrade. FIGS. 38 and 39 additionally show perspective views of the mounting 10 which includes a front and rear clamping member 27, 3900. A glass panel is located between the first 14 and second flanges 15 of the mounting 10, wherein the panel is clamped between the first and second clamping members 27, 3900. It will be appreciated that whilst the front clamping member 27 moves as will be discussed below, the rear clamping member 3900 does not move. The clamping members 27, 3900 are preferably at least partially made of a rubber or polymer material to ensure that the glass panel 11 is not marked when a clamping force is applied.

As shown in FIGS. 36 and 39, the first flange 14 includes two threaded apertures 99 which pass through the first flange 14 and into the cavity 17. A pair of grub screws 28 are screwed into the threaded apertures 99. The ends of the two grub screws 28 press against a surface of the front clamping member 27 as the screws 28 are screwed into engagement with the threaded apertures 99. When the two threaded fasteners 28 are tightened using an Allen key or the like, the threaded members 28 urge against the surface of the front clamping plate 27 which moves toward and clamps against the front surface of the glass panel 11 located within the cavity such as to fix the panel within the cavity 17 of the mounting 10.

As shown in FIGS. 36 and 38, the front clamping plate 27 is tight fittingly received within a recess 26 within the inner wall of the flange 14. As the grub screws 28 are tightened and the respective ends of the grub screws 28 protrude outward from the inner wall of the flange 14, the front clamping plate 27 is displaced from the recess 26 to clamp against the front surface of the glass panel 11.

As shown in FIG. 39, the rear clamping plate 3900 includes an "L" shaped profile including a rear plate member 3930 which rests against the inner rear wall of the flange 15 and a base plate member 3940 which rests upon the base 16 of the cavity 17 of the mounting 10. Both clamping members 27, 3900 can be removed from the mounting 10 in order to aid installation and then reinserted into the cavity prior to securing the glass panel as will be discussed below. The clamping members 27, 3900 can be provided with one or more portions of re-adherable glue on the rear surfaces. The re-adherable glue for the clamping member 27 helps retain the clamping member 27 within recess 26 whilst the mounting is being installed whilst still allowing the clamping member 27 to be removed for particular installation processes and also urged into frictional contact with the glass panel 11. The re-adherable glue for the clamping member 3900 helps maintain its position within the cavity 17.

A number of methods of installing the mounting of FIGS. 35 to 39 will now be described.

In particular, for concrete, one or more holes are drilled into the concrete structure for receiving one or more of the threaded members 3512, 3514, 3516. In particular, it is desirable for particular concrete installations such as a vertically thin concrete slab (~30 cm to 50 cm thick vertically) that only a single threaded fastener 3514 is used for installing the mounting 10 and as such only a single hole is drilled into the concrete slab. The singe hole is generally drilled approximately 15 cm from the upper or lower surface of the concrete slab to enable the hole to withstand expected forces. However, in other situations where the structure which the mounting 10 is to be secured thereto is vertically thicker, one or more of threaded fasteners 3512, 3516 can additionally be used and thus corresponding holes are also drilled into the structure.

Next, the method includes screwing threaded members 3514 and optionally 3512 and 3516 into the second flange 15 of the mounting 10 via the holes 18B, 18A and 18C respectively. Next, the method includes aligning the mounting 10 with other mountings being secured to the structure or which have already been secured to the structure 22 using a string line or laser if required. Next, the threaded members 3514 and optionally 3512 and 3516 are secured into the holes in the structure 22 using an adhesive. Once the adhesive has cured, the glass panel 11 can be located within the cavity 17 of the mounting 10. The grub screws 28 can then be tightened such that the clamping plates 27, 3900 clamp against the panel 11. Optionally, an additional nylon wedge gasket can be inserted under the glass panel 11 within the cavity 17 to adjust the top edge of the respective glass panel 11 so it is level with an adjacent glass panels prior to clamping. Optionally, lock tight metal adhesive may be used to secure the bolts 3512, and/or 3514 and/or 3516 within the flange 15 of the mounting 10.

In relation to installing the mounting 10 to metal or timber beams in easy to access areas, two bolts 3512, 3516 are screwed into the back of the mounting 10. Lock tight metal adhesive may be used to secure the bolts 3512, 3516 within the flange 15 of the mounting 10. The bolts 3512, 3516 can then pass through holes in the beam, wherein ends of the bolts 3512, 3516 which protrude from the rear of the beam are secured with washers and nuts such that the mounting 10 is secured to the beam. The glass panel 11 can then be inserted into the cavity 17, adjusted and aligned and then secured as described above.

Figure 43:
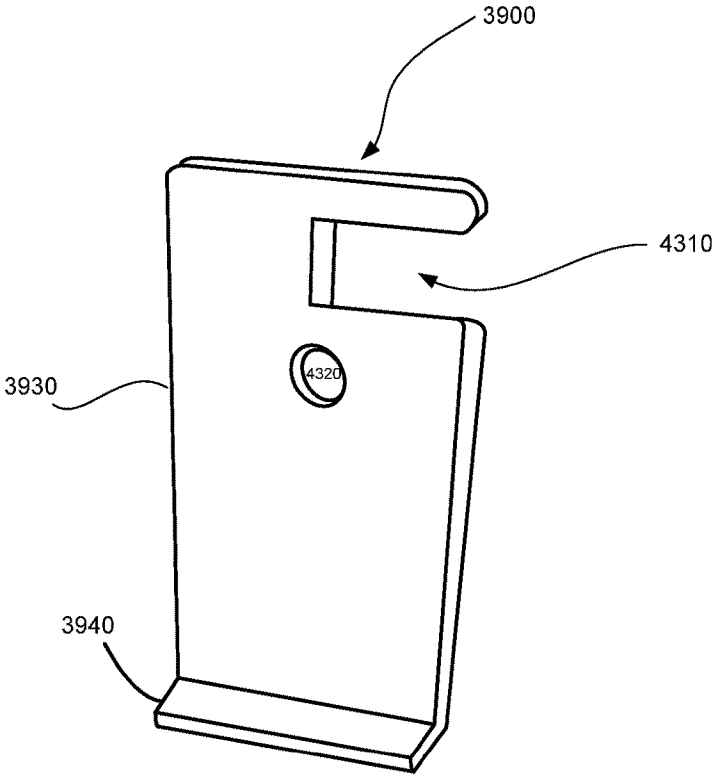
FIG. 43 is a perspective view of a clamping plate of the mounting of FIG. 40.
Figure 46:
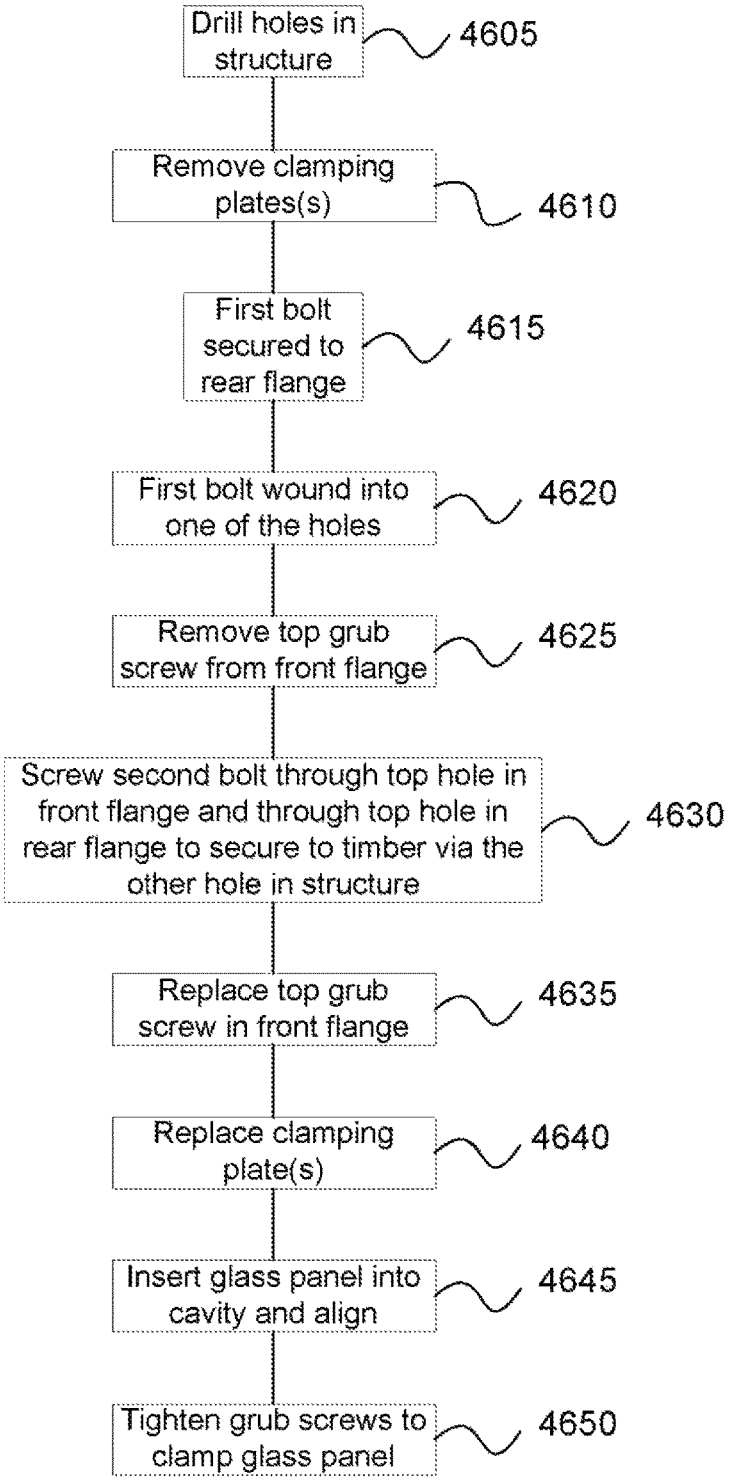
FIG. 46 is a flowchart, representing a method of installation of the mounting of FIG. 35 to a structure such as timber.

In relation to installing the mounting to a structure such as timber in difficult to access areas, this method will be described in relation to a flowchart depicted in FIG. 46. At step 4605, a pair of holes are drilled into the timber in a vertical row. Next, the clamping plate 27 and optionally 3900 (as shown in FIG. 43, the rear clamping plate 3900 can include holes so as to remain within the cavity 17 during installation if desired) are removed from the mounting 10. At step 4615, a first bolt 3516 is screwed into one of the respective apertures 18C in the back of the mounting 10 such that it is secured to the mounting 10. The protruding end of the first bolt 3516 is then secured into the lower hole in the timber at step 4620, wherein the mounting 10 is wound in a clockwise direction (by convention but it will be appreciated that a bolt with an opposite thread could be provided) such that the first bolt 3516 is screwed into the timber into the hole. Other mountings can additionally be screwed into the timber and aligned as discussed in the other installation methods using a string line or laser alignment means. At step 4625, the top grub screw 28 which is co-axial with hole 18A is screwed out from flange 14. At step 4630, a second bolt 3512 is screwed into and through hole 99 of the flange 14 which then protrudes through co-axial hole 18A in flange 15 such that the second bolt 3512 projects rearward from the flange 15 to engage with and protrude into an upper second hole in the timber. An Allen key may be used to engage an end of the second bolt 3512 to screw the second bolt through hole 99 and engage with hole 18A such that the second bolt no longer protrudes into the cavity 17. It will be appreciated that the Allen key can protrude through the flange 14 to engage the end of the second bolt 3512 for actuation. Once the second bolt 3512 has been screwed into the timber, at step 4635, the removed grub screw 28 can again be screwed back into the top hole 99 in the front flange 14 of the mounting 10. At step 4640, the clamping plate 27 and optionally 3900 can then be reinserted into the recess 26 and cavity 17 respectively. At step 4645, the glass panel 11 can also be inserted into the cavity 17. At step 4650, the grub screws 28 can be tightened such that the clamping plates 27, 3900 clamp against and secure the glass panel 11 within the cavity 17 by friction.

It will be appreciated by those skilled in the art that particular steps discussed above can be performed in different orders to achieve the same end result. For example, the second bolt 3512 can be loosely located within the hole 99 prior to winding, and then upon the winding process having been completed, then continuing with the progression of the second bolt 3512 to secure the mounting to the structure 22.

Referring to FIGS. 17 to 26 there is schematically depicted another embodiment of a mounting 100. The mounting 100 would be employed to support sheets (panels) 110 and 120 fixed to a supporting structure. The sheets 110 and 120 would extend upwardly relative to the structure.

The mounting 100 includes a body 130 that would be fixed to the structure so as to extend generally upwardly relative thereto. The upper end of the body 130 provides two pairs of flanges 140 and 150 that are preferably generally parallel and co-extensive. Located between the flanges 140 is a first slot 160, while located between the flanges 150 is a second slot 170. Each slot 160 and 170 receives a respective one of the sheets 110, 120, so that the slots 160 and 170, and sheets 110 and 120 are generally co-planar.

Located in the first slot 160 is at least one clamp plate 180. In this embodiment there are two clamp plates 180, with the sheet 110 located therebetween. In respect of the slot 170, clamp plates 190 are provided so as to be located in the slot 170 so that the sheet 120 is located therebetween.

Threadably engaged with the body 130 is a plurality of threaded fasteners 200 that engage the clamp plates 180 and 190 to urge the clamp plates 180 and 190 into engagement with the associated sheet 110, 120. By doing so, the plates 180 and 190 frictionally clamp the sheets 110 and 120 to the mounting 100.

Located between the first set of flanges 140 and the second set of flanges 150 is a spacer portion 210 of the body 130. The body 130 also provides a stem 240 to be fixed to the supporting structure 22.

The mounting 100 engages the sheets 110 and 120 adjacent the lower corners 220 thereof so that the mounting 100 is located adjacent the upwardly extending edges 230 of the sheets 110 and 120.

In FIGS. 19 to 22 there is schematically depicted a modification of the mounting 100. In this embodiment there are only two clamp plates 180, with each clamp plate 180 being engaged by a pair of threaded fasteners 200. Also in this embodiment, the stem 240 is generally circular in transverse cross-section and is provided with transverse passages 250. Additionally, the stem 240 is hollow so as to provide an upwardly extending cavity 260.

In FIGS. 23 to 26 there is schematically depicted a modification of the mounting 100. In this embodiment the pair of flanges 140 extends generally perpendicular to the flanges 150. Accordingly the mounting 100 provides for the supporting of glass sheet 110, 120 that is generally upwardly oriented, but with the sheets (and slots 140 and 150) inclined by approximately 90°. However it should be appreciated that the flanges 140 and 150 could be arranged at other angles apart from 90°.

Figure 27:
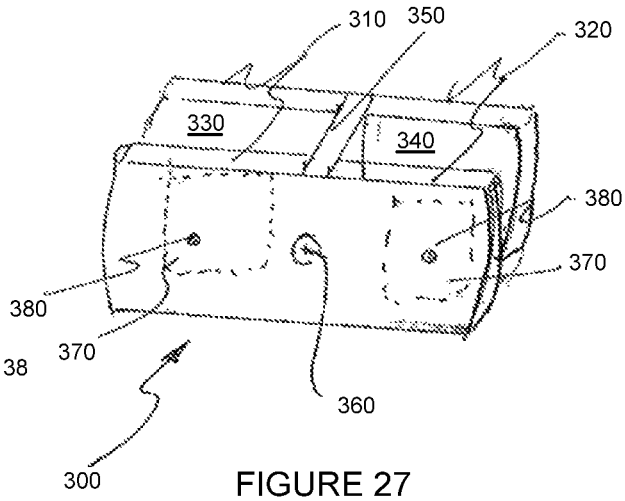
FIG. 27 is a schematic isometric of a joining bracket for glass sheet.
Figure 28:
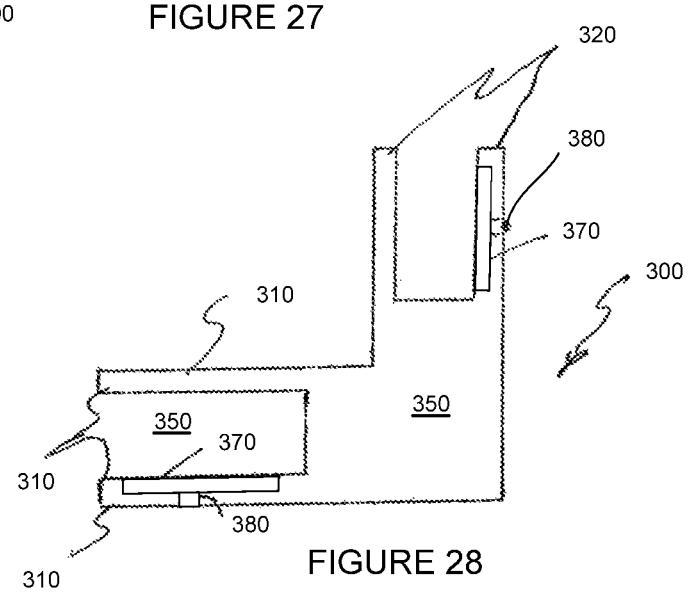
FIG. 28 is a schematic top plan of modification of the bracket of FIG. 27.

In FIGS. 27 and 28 there are schematically depicted joining brackets 300. The brackets 300 include a first pair of flanges 310 and a second pair of flanges 320, with a first slot 330 being located between the flanges 310, and a second slot 340 being located between the flanges 320. The slots 330 and 340 are separated by a divider 350, with the assembly being secured together by one or more threaded fasteners 360. In one or both of the flanges 310, and one or both of the flanges 320, there is a clamp plate 370 engaged by a threaded fastener 380 so that the associated clamp plate 370 may be moved into frictional engagement with a glass sheet located in the associated slot 330 or 340. In the embodiment of FIG. 27, the glass sheets (and slots 330 and 340) are generally co-planar. In the embodiment of FIG. 28, the glass sheets (and slots 330 and 340) although still being vertically oriented, are inclined by approximately 90°. In that regard it should be appreciated that the flanges 310 and 320 may be inclined by other angles apart from 90°.

Figure 29:
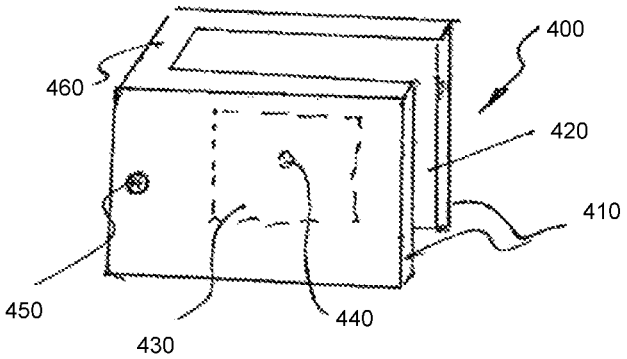
FIG. 29 is a schematic isometric view of a further modification of the bracket of FIG. 27.

In FIG. 29 there is schematically depicted a further bracket 400. Typically the bracket 400 would be located adjacent an upper edge of the glass sheet and will secure the glass sheet to an adjacent wall or other structure. The bracket 400 includes a pair of spaced flanges 410 between which there is located a slot 420 to receive a glass sheet. At least one of the flanges 410 would be provided with a clamp plate 430 an associated threaded fastener 440 to urge the plate 430 into frictional engagement to a glass sheet located in the slot 420. The assembly would be held together by means of a threaded fastener 450. Typically the bracket 400 would have an end wall 460 through which threaded fasteners would pass to engage adjacent wall or structure. As an alternative embodiment, the flange 410 could be provided with threaded fasteners again to secure the bracket 400 to an adjacent wall or structure.

Figure 30:
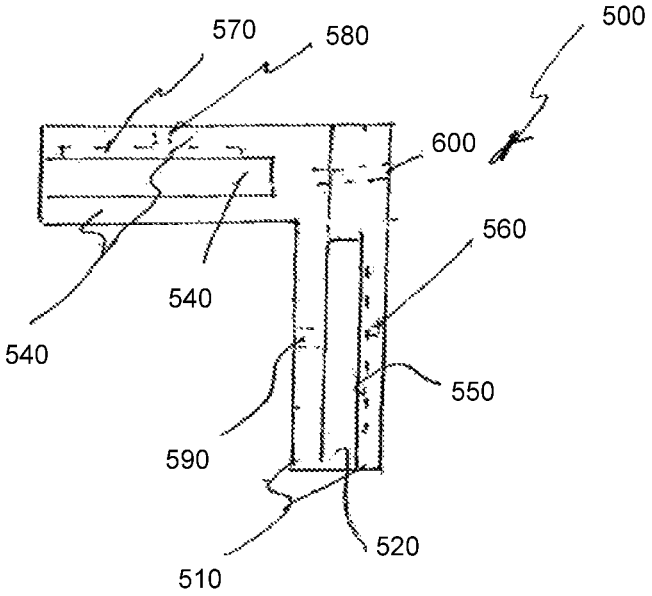
FIG. 30 is a schematic plan view of a mounting for a glass sheet.
Figure 31:
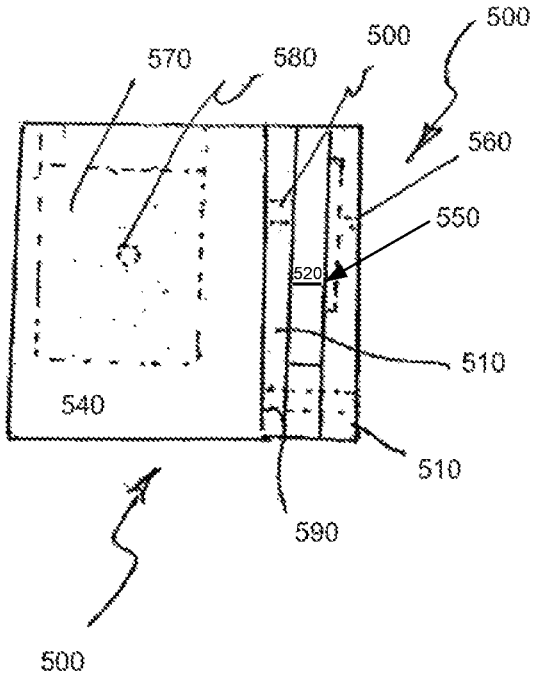
FIG. 31 is a schematic side elevation of a mounting for glass sheet.

In FIGS. 30 and 31 there is schematically depicted a mounting 500 for glass sheet. In this embodiment the mounting 500 is intended to be fixed to a building or structure so as to be adjacent a corner.

The mounting 500 includes a pair of generally parallel co-extensive flanges 510 between which there is located a generally vertically oriented slot 520. A pair of generally parallel co-extensive flanges 530 provides a slot 540. In this embodiment the slot 540 is generally perpendicular to the slot 520. However in other embodiments the slots 520 and 540 could be inclined by an acute or obtuse angle.

In the slot 520 there is provided a clamp plate 550 engaged by a threaded fastener 560 to urge the clamp plate 550 into frictional engagement with a glass sheet located in the slot 520. A similar clamp plate 570 is included in the slot 540 and engaged by a threaded fastener 580. Accordingly the glass sheets would be inclined by approximately 90° while also being generally vertically oriented.

In this embodiment one of the flanges 510 is provided with one or more threaded fasteners 590 to secure the mounting 500 to a support structure 22. Preferably the mounting 500 is secured together by means of one or more threaded fasteners 600.

Figure 32:
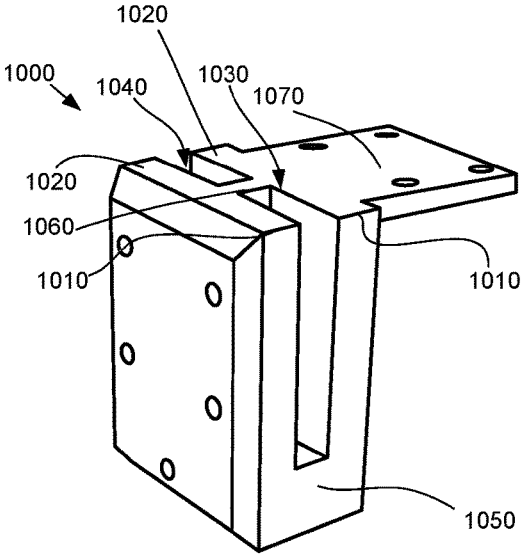
FIG. 32 is a schematic isometric view of a mounting for glass sheet.
Figure 33A:
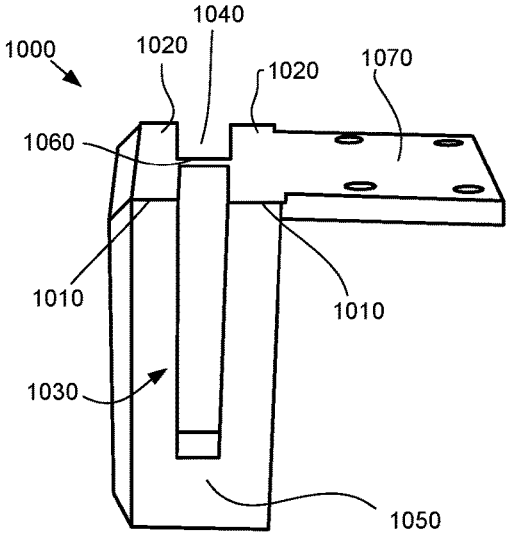
FIG. 33A is a schematic side isometric view of the mounting of FIG. 32.

In FIGS. 32 and 33A there is schematically depicted a mounting 1000. The mounting 1000 would receive and secure together two glass sheets with the glass sheets generally vertically oriented and with adjacent vertical edges. The sheets are preferably parallel. Preferably, the mounting 1000 would engage the lower adjacent corners of the glass sheets.

The mounting 1000 has a first pair of generally parallel and coextensive flanges 1010 and a second pair of generally parallel and coextensive flanges 1020. The flanges 1010 provides a cavity 1030 while the flanges 1020 provide a cavity 1040. Each cavity 1030 and 1040 receives a respective one of the glass sheets. Extending between each of the flanges 1010 and 1020 is an end (bottom) flange 1050 upon which the glass sheet can rest. The cavities 1030 and 1040 are separated by a divider 1060.

Extending from the flanges 1010 and 1020 is a mounting flange 1070 through which threaded fasteners would pass to secure the mounting 1000 to a generally horizontal supporting surface of an adjacent structure 22.

Figure 33B:
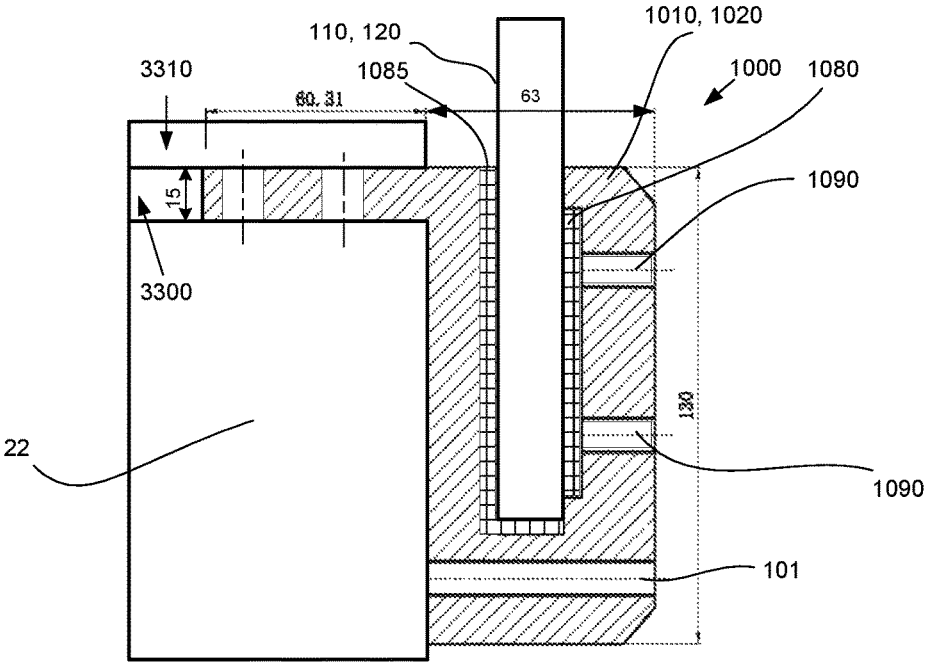
FIG. 33B is a cross-section side view of the mounting of FIG. 32 when installed to a structure.

As shown in FIG. 33B, one of the flanges 1010 and one of the flanges 1020 would be provided with a clamp plate 1080 and an associated threaded fastener 1090, with the threaded fasteners 109 urging the plates 1080 into clamping engagement with their respective glass sheet, wherein the rear surface of the glass sheet presses against the rear clamping plates 1085.

As can be seen in FIG. 33B, the mounting flange 1070 can placed onto of the edge of the structure 22. Next, the mounting is secured to the structure 22 via fasteners which protrude through holes in the mounting flange 1070. Grout 3300 can then be placed over the remaining exposed top surface of the structure 22 as well as some of the top surface of the mounting flange 1070. Next, tiles 3310 can be placed over the laid grout 3300. It will be appreciated that this installation process covers the mounting flange 1070.

Figure 34A:
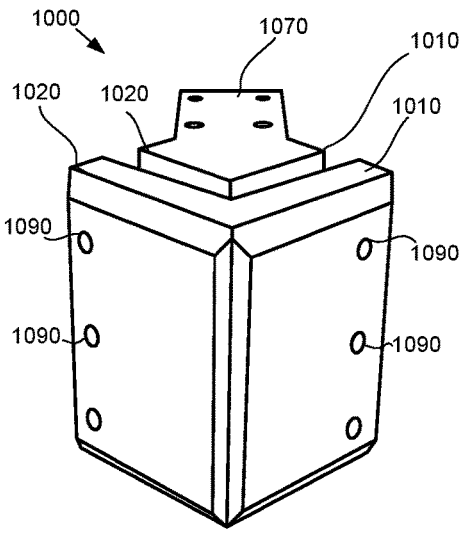
FIG. 34A is a schematic front isometric view of a modification of the mounting of FIG. 32.
Figure 34B:
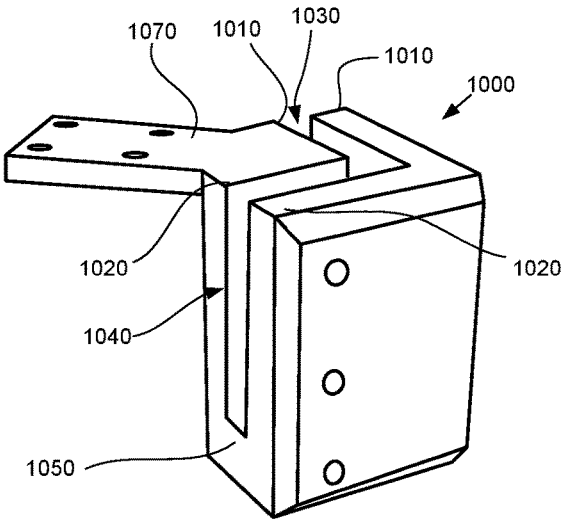
FIG. 34B is a schematic partial side isometric view of the mounting of FIG. 34A.
Figure 34C:
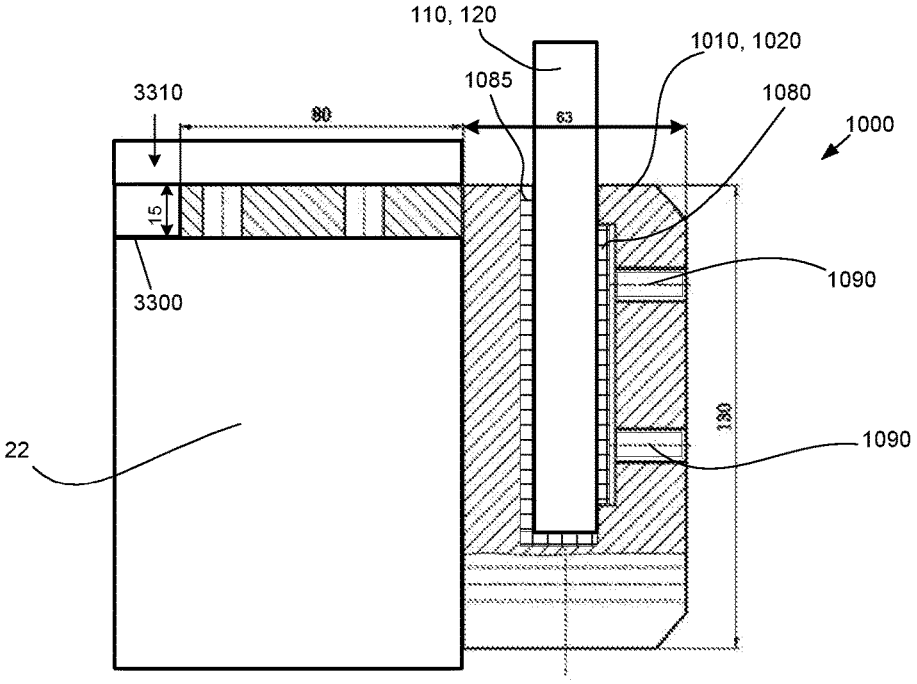
FIG. 34C is a cross-section side view of the mounting of FIG. 34A when installed to a structure.

In the embodiment of FIGS. 32 and 33A and 33B, the flanges 1010 and 1020 are generally parallel. In the embodiment of FIGS. 34A and 34B the flanges 1020 are approximately perpendicular to the flanges 1010. However, acute or obtuse angles may also be employed. FIG. 34C shows a similar installation of the mounting 1000 which was discussed in relation to FIG. 33B and therefore it will be appreciated that a similar installation process applies for this embodiment of the mounting 1000, albeit the panels 110, 120 are inserted into and secure within the cavities 1030, 1040 at substantially perpendicular directions. The mounting 1000 can include a divider 1060, as illustrated in FIGS. 32 and 33A, which is located between the cavities 1030, 1040 to define the separation of the cavities 1030, 1040 and also to isolate the panels 110, 120 from each other when inserted and secured within the respective cavities 1030, 1040 of the mounting 1000.

Figure 41:
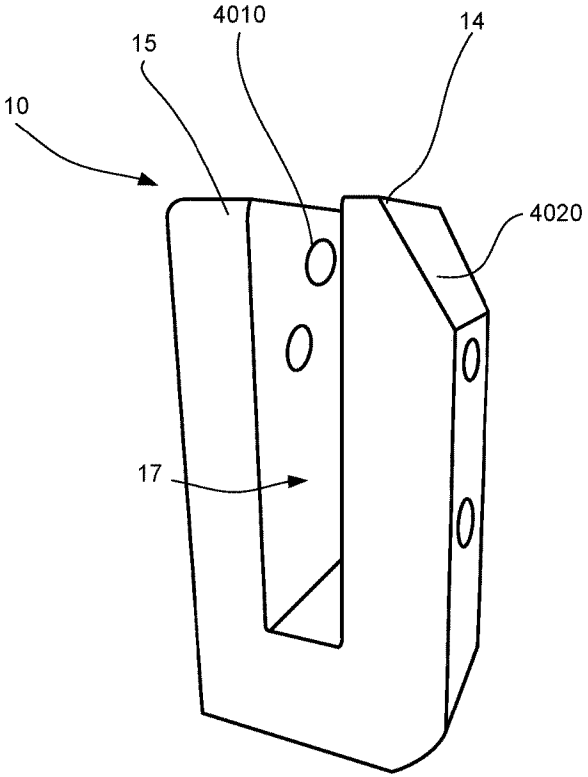
FIG. 41 is second perspective view of the mounting of FIG. 40.
Figure 40:
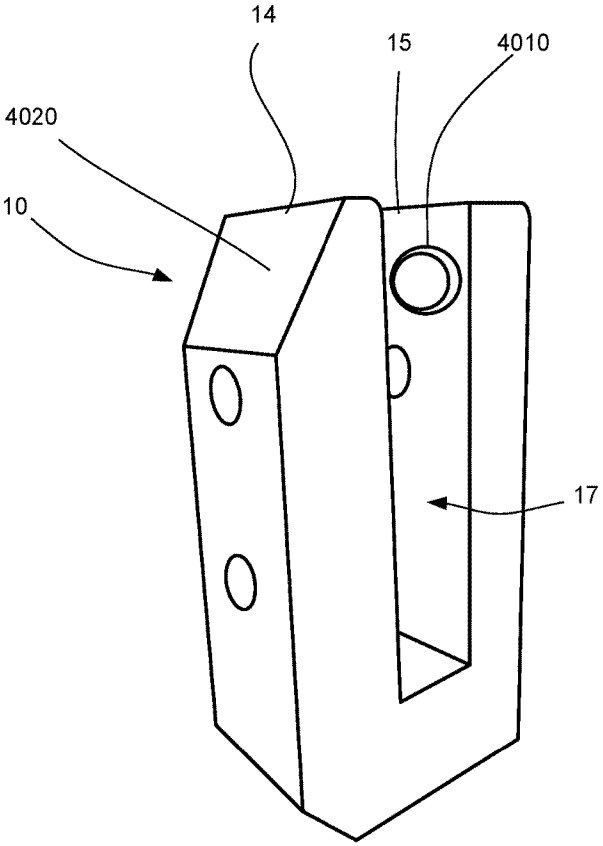
FIG. 40 is a first perspective view of a modification of the mounting of FIG. 35.
Figure 42:
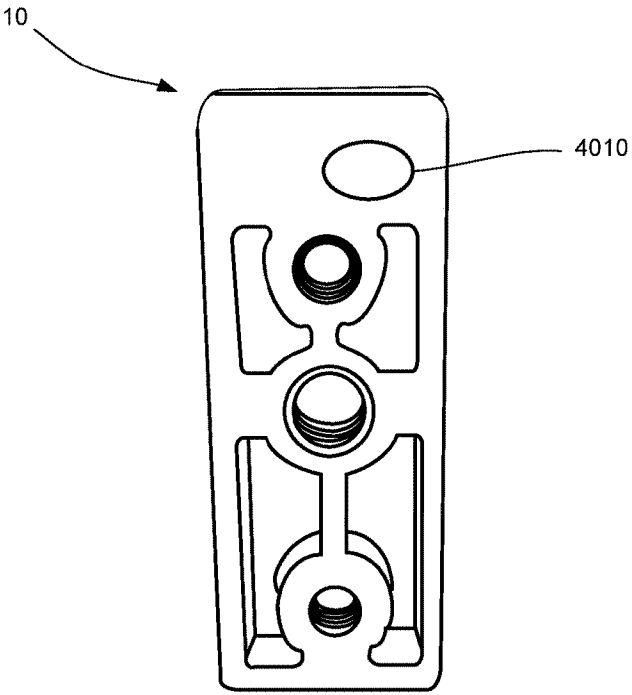
FIG. 42 is a rear perspective view of the mounting of FIG. 40.

Referring to FIGS. 40 to 42 there is shown another embodiment of the mounting 10. In particular the rear flange 15 includes an angled hole 4010 located adjacent the upper corner of the rear flange 15. The angled hole 4010 enables an additional bolt to be inserted into the hole 4010 to secure the mounting 10 to the structure 22 once the mounting 10 has been secured to the structure 22 with bolts 3512, and/or 3514, and/or 3516. Due to the angled orientation of the hole 4010 relative to the plane of the rear flange 15, a bolt can be inserted into the hole and a tool can be used to urge the bolt into place with relative ease despite the tight area within the cavity 17.

As also shown in FIGS. 40 and 41, the front flange 14 includes an angled upper front surface 4020 in order to prevent children or the like using the mounting as a step. The angled face 4020 is approximately 60 degrees relative to the horizontal.

Referring to FIG. 43 there is shown an example of the second clamping plate 3900 for the mounting of FIG. 40. The second clamping plate 3900 includes a cut-out section 4310 to enable the additional bolt to be inserted into angled hole 4010. Additionally, the second clamping plate 3900 includes a hole 4320 which is co-axial with hole 18A such that the second clamping plate 3900 need not be removed from the cavity 17 when installing the mounting 10 to timber and the like as discussed earlier.

Figure 44:
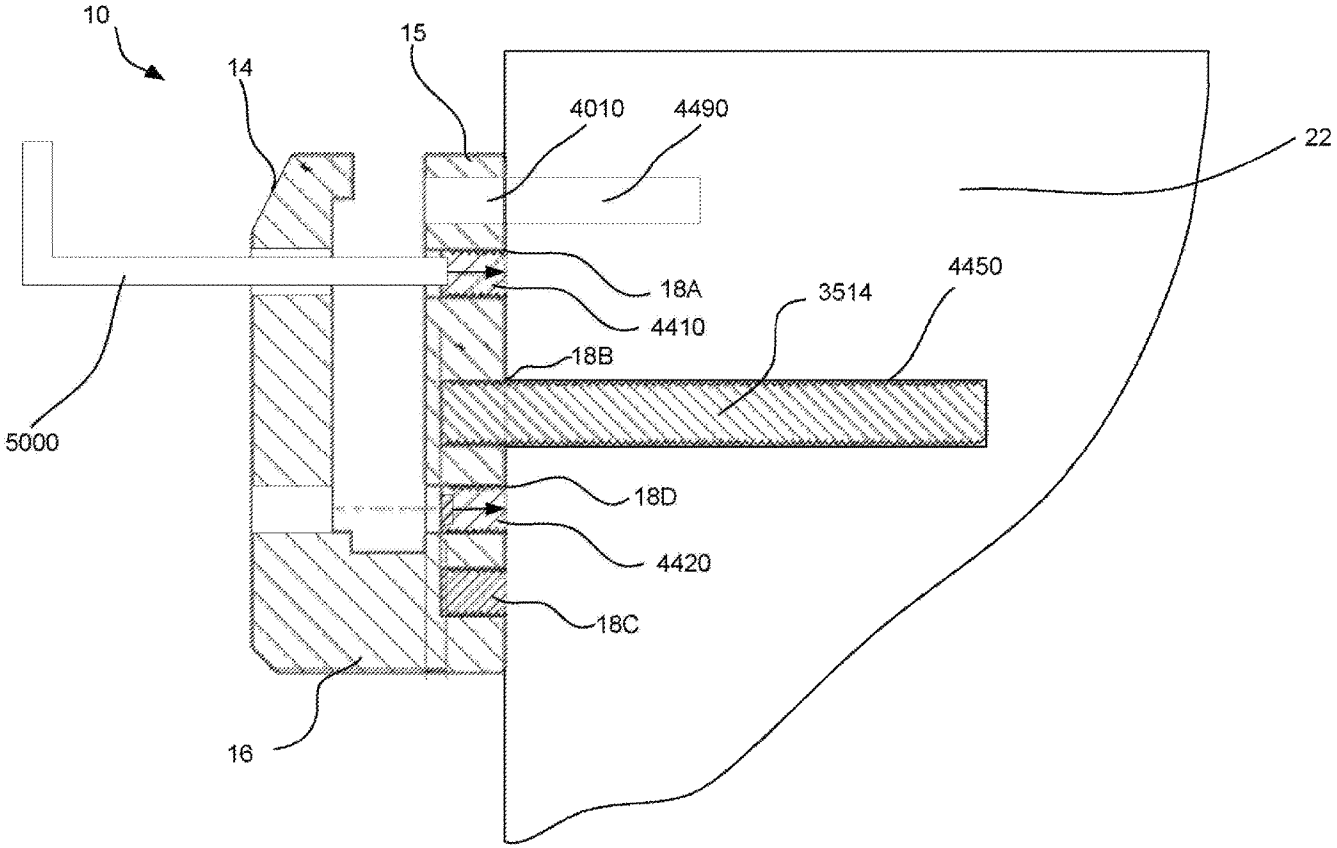
FIG. 44 is a cross-sectional side view of a modification of the mounting of FIG. 40 being installed to a structure.
Figure 45:
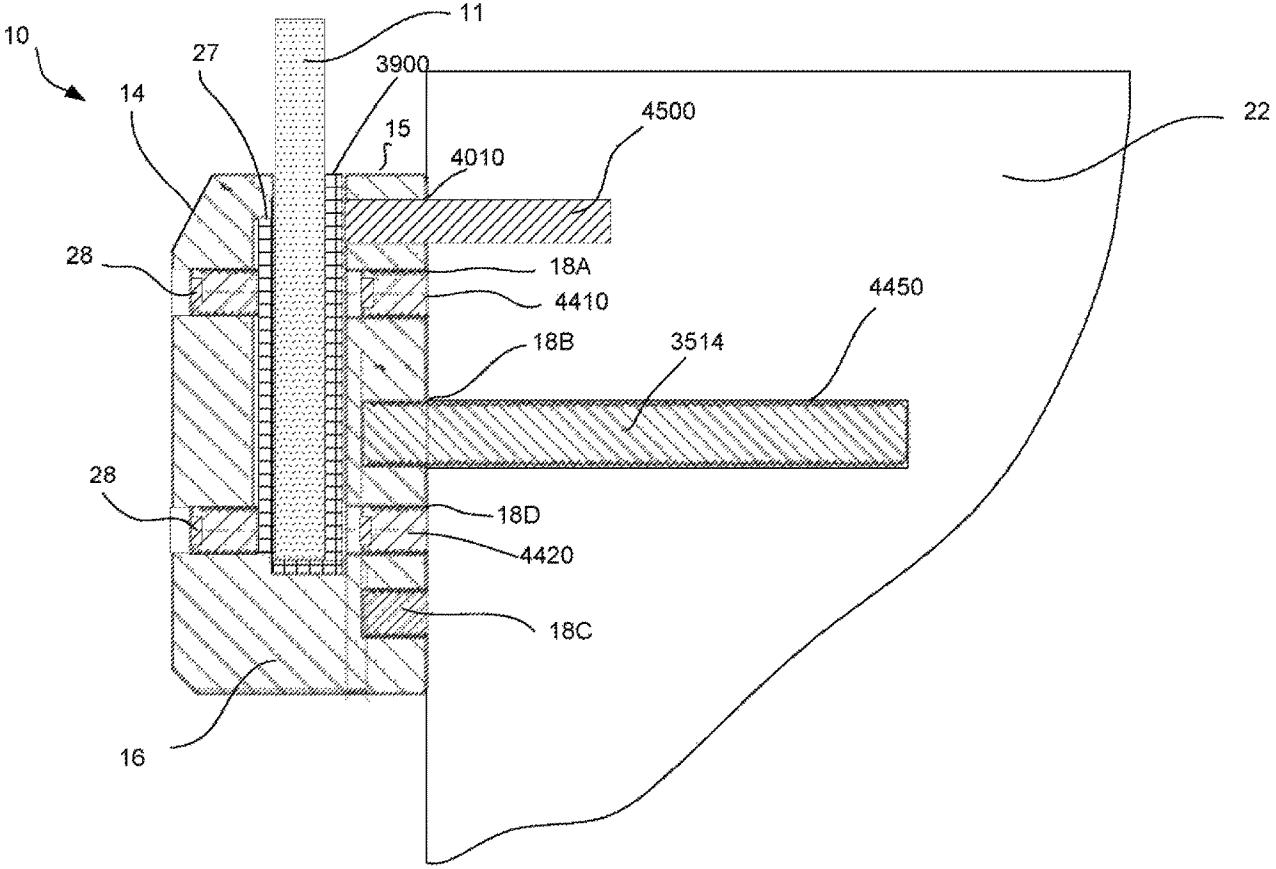
FIG. 45 is a cross-section side view of the mounting of FIG. 44 upon installation to the structure.

Referring to FIGS. 44 and 45 there is shown another embodiment of the mounting 10 being secured to a concrete slab 22. Like features of the mounting 10 have been discussed in previous embodiments and should be appreciated by those skilled in the art. The rear flange 15 includes an additional hole 18D which is co-axial with the lower hole 99 which engages the grub screw 28.

Figure 47:
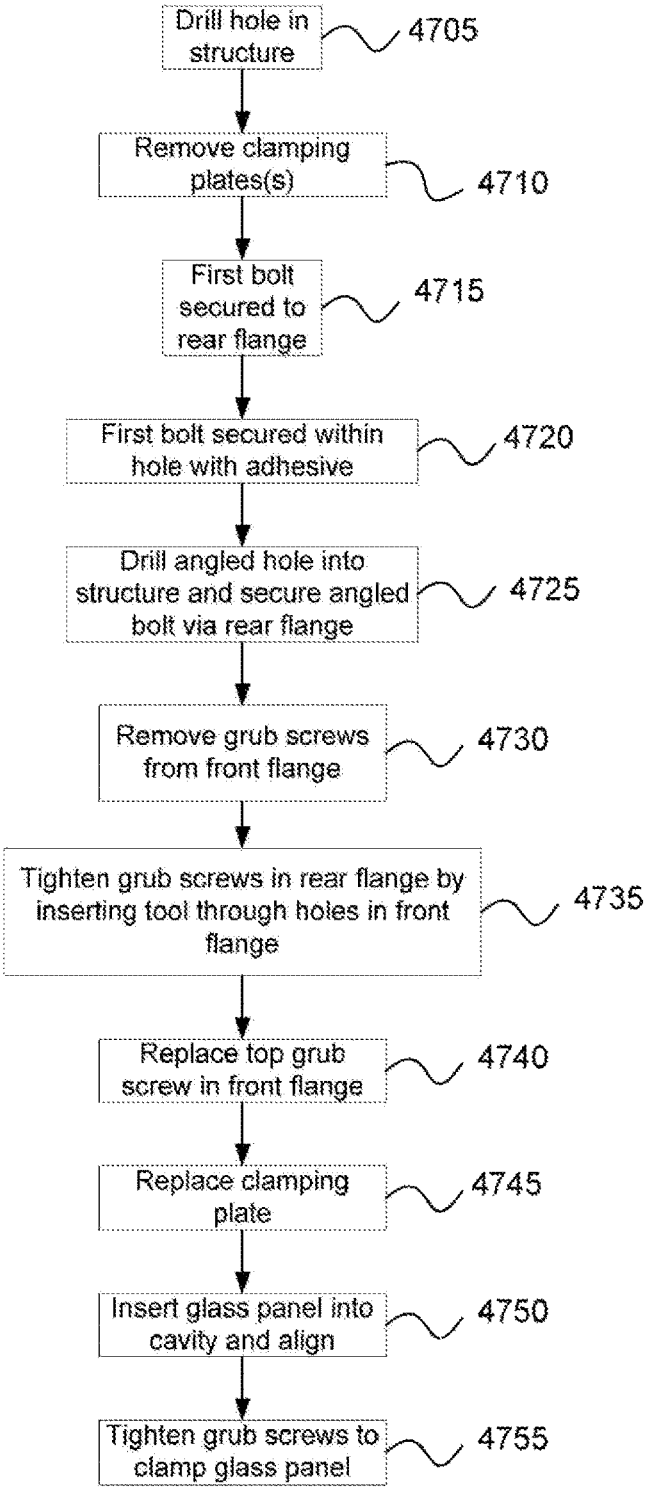
FIG. 47 is a flowchart representing a method of installation of the mounting of FIGS. 44 and 45 to a structure such as concrete.

A method of installing the mounting of FIGS. 44 and 45 will now be discussed in relation to the flowchart provided in FIG. 47. In particular, at step 4705, a hole 4450 is drilled into the structure 22. At step 4710, the clamping plate 27 is removed from the recess 26. At step 4715, a bolt 3514 is secured to the hole 18B in the rear flange 15. At step 1720, the bolt 3514 projecting rearward of the rear flange 15 is secured into the hole 4450 in the structure 22. In particular, the bolt may be secured within the hole 4450 using an adhesive such that the rear surface of the rear flange sits substantially flush against the vertical structure 22. At step 4725, an angled hole 4490 can be drilled into the structure 22 via angled hole 4010 in the rear flange 15, wherein the mounting is secured to the structure using an additional bolt 4500 which has a longitudinal axis angled relative to the plane of the rear flange 15. At step 4730, the grub screws 28 are removed from the front flange 14 to expose holes 99 which are co-axial with holes 18A and 18D. At step 4735, grub screws 4410 and 4420 which are engaged within holes 18A and 18D are tightened by placing a tool, such as an Allen key 5000, through the holes 99 in turn such that a rear force is exerted against the structure 22 to provide further rigidity to the secured mounting 10. At step 4740, the grub screws 28 are replaced in holes 99. At step 4745, the clamping plate 27 is replaced in recess 26. At step 4750, the glass panel 11 is inserted into the cavity 17 and aligned with other panels 11 of other mountings 10. At step 4755, the grub screws are tightened using a tool such as the Allen key 5000 to urge the clamping plate 27 to urge against and clamp the panel 11 in combination with clamping plate 3900.

It will be appreciated by those skilled in the art that particular steps discussed above can be performed in different orders to achieve the same end result.

It will be appreciated that the grub screw arrangement 4410, 4420 for holes 18A, 18D can be used with other embodiments previously discussed such that the mounting is provided with additional rigidity in its installed state by exerting a rearward force against the vertical surface of the structure 22. In embodiments where the mounting secures multiple panels of glass, multiple pairs of holes 18A, 18D can be provided in the rear flange and multiple pairs of grub screws 4410, 4420 can be used to exert a force against the vertical surface of the structure 22.

It will be appreciated that the mounting 10 of FIGS. 35 and 44 provides substantial advantages in relation to the versatile installation methods for various structures. For concrete structures, the method described in relation to FIG. 47 can be used. For structures such as timber which cannot utilise a nut and washer fastener arrangement, the method described in relation to FIG. 46 can be used. For structures such as beams, the method previously discussed in relation to nuts and washers can be utilised. It will be appreciated that hole 18A can be used for multiple purposes. For example, when the mounting 10 is being installed to concrete, the hole 18A engages the grub screw 4410 to exert a rearward force against the structure to provide additional rigidity for the installation of the mounting. In contrast, when the mounting 10 is being installed to timber, the hole 18A is used to engage a bolt 3512 which projects into the timber to secure the mounting to the structure 22.

It will also be appreciated that a kit may be provided which includes the mounting 10, a plurality of bolts and a plurality of grub screws to enable the installer to use the bolts and grub screws according to the particular structure 22 which the mounting is to be secured thereto.

It will be appreciated that in certain embodiments the mounting 10 may be integral with the threaded member 3514. In these embodiments, it is not necessary for the installer to engage the threaded member 3514 with the hole 18B.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

Many modifications will be apparent to those skilled in the art without departing, from the scope of the present invention.

The invention claimed is:

1. A method of securing a mounting to a structure for a glass balustrade arrangement, the mounting including a first flange having a first threaded hole, a second flange having a second threaded hole coaxial with the first threaded hole and also having a third threaded hole, a cavity located between the first and second flange, and one or more clamping members associated with the first and second flanges, wherein the method includes:

winding the mounting to secure a first threaded member which extends from the second flange into a first hole of the structure;

progressing a second threaded member through the first threaded hole of the first flange and partly through the second threaded hole of the second flange, wherein a portion of the second threaded member projects and secures within a second hole of the structure;

locating a glass panel within the cavity of the mounting; and clamping the glass panel by actuating the one or more clamping members of the mounting, wherein at least a portion of the clamped glass panel overhangs an edge of the structure.

2. The method according to claim 1, wherein the method includes securing the first threaded member with a third threaded hole located in the second flange.

3. The method according to claim 1, wherein the method includes progressing a first screw located within the first threaded hole of the first flange after securing the second threaded member within the second hole of the structure, wherein progression of the first screw causes the first screw to contact one of the clamping members to thereby clamp the glass panel.

4. The method according to claim 3, wherein the mounting includes an additional threaded hole in the first flange for receiving an additional screw, wherein the method includes progressing the additional screw within the additional threaded hole to contact one of the clamping members to thereby clamp the glass panel.

5. The method according to claim 1, wherein the method includes inserting a portion of a tool through the first threaded hole to engage and progress the portion of the second threaded member through the second threaded hole of the second flange.

6. A method of installing a mounting, the mounting including a body having a first slot defined by a first pair of flanges and a second slot defined by a second pair of flanges, each slot being configured to receive a respective one of the panels so that the panels are support in an upward orientation with adjacent edges; a first clamping member in the first slot; a second clamping member in the second slot; and a plurality of threaded fasteners threadably engaged with the body and engaged with the clamping members to urge the clamping members into clamping engagement with a respective one of the panels, wherein the method includes:

securing the mounting to a structure;

locating a first glass panel within the first slot;

locating a second glass panel within the second slot;

actuating the plurality of threaded fasteners to urge the clamping members to clamp against the first and second panels;

wherein the body includes a rear surface which rests against a structure for the mounting to be secured thereto, wherein the rear surface includes one or more threaded holes, and wherein the method further includes:

engaging a respective one or more threaded members with the one or more threaded holes in the rear surface, and securing each threaded member within holes defined in the structure;

wherein the body includes a threaded fastener hole to receive one of the threaded fasteners for engaging one of the clamping members, wherein the threaded fastener hole is coaxial with one of the threaded holes provided in the rear surface, and wherein the method further includes:

inserting a portion of a tool through the threaded fastener hole to progress the threaded member to project rearward of the rear surface, progressing one of the threaded members through the threaded fastener hole and to at least partially progress the respective threaded member to project through the coaxial threaded hole provided in the rear surface, and progressing a threaded screw within one of the threaded holes or a further hole of the second flange to urge against the structure when the mounting is secured to the structure.

7. A mounting for a glass panel of a glass balustrade arrangement, the mounting including:

a base, the base being of a "U-shaped" configuration so as to have a first and a second flange joined by an end flange, the flanges providing an open cavity within which the glass panel is to rest so as to be at least partly supported by the mounting with the glass panel generally upwardly oriented, wherein the first and second flanges are generally upright, and said end flange is a bottom flange;

a clamping member adjacent the first flange and located in the cavity;

at least one threaded fastener engaged with said first flange and clamping member to urge the clamping member to engage the glass panel to clamp the glass panel between the second flange and clamping member to fix the glass panel to the mounting; and wherein:

the second flange has at least one aperture which at least another threaded fastener engages to fix the mounting to a substantially vertical surface of an edge of a structure such that at least a portion of the glass panel which rests within the cavity overhangs the edge of the structure;

the first flange includes a threaded fastener hole to receive one of the threaded fasteners for urging the clamping member to clamp the glass panel, wherein the threaded fastener hole is coaxial with one of the at least one aperture provided in the second flange;

one of the at least one aperture in the second flange or a further aperture of the second flange is configured to receive a threaded screw which is progressed at least partially there through for pressing against the structure without progressing into the structure when the mounting is secured thereto;

wherein one end of the at least another threaded fastener is engagable by a tool which is inserted through the threaded fastener hole of the first flange; and wherein actuation of the tool causes the at least another threaded fastener to fix the mounting to the structure.

8. The mounting according to claim 7, wherein said second flange includes a first flange portion that is generally upwardly oriented, and a second flange portion extending generally horizontally from the first flange portion, with at least one of the apertures formed in said second flange portion so as to be generally vertically extending.

9. A mounting assembly including:

a mounting including:

a body having a slot defined by a front flange and rear flange, the slot being configured to receive a glass panel, wherein the front flange includes:

an outer surface including an inclined surface defining a tapered profile of the front flange thereby restricting the front flange being used as a foothold, and a plurality of threaded holes that extend from the outer surface to an inner surface of the front flange;

a first member and a second member for clamping the glass panel within the slot, wherein the first member is movable from a stowed position, such that the first member is located within a cavity provided by the inner surface of the front flange, to a clamping position such that the first member at least partially protrudes from the cavity;

a plurality of screws threadably engaged with the plurality of threaded holes, wherein actuation of the plurality of screws cause the first member to at least partially protrude from the cavity and urge against the glass panel locatable within the slot so that the glass panel is clamped between the first member and the second member;

a threaded fastener projecting rearwardly from a rear surface of the rear flange; and wherein the second clamping member includes a hole for accessing a hole in the rear surface of the rear flange which the threaded fastener rearwardly projects therefrom.

* * * * *